US008890689B2

(12) United States Patent
Ezzo et al.

(10) Patent No.: US 8,890,689 B2
(45) Date of Patent: Nov. 18, 2014

(54) ADJUSTABLE DUAL LOOP CABLE SECURITY DEVICE

(75) Inventors: Mark Ezzo, Matthews, NC (US); William J. Kozlowski, Jr., Tega Cay, SC (US); Matthew R. Shute, Charlotte, NC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 0 days.

(21) Appl. No.: 12/938,124

(22) Filed: Nov. 2, 2010

(65) Prior Publication Data

US 2011/0102179 A1 May 5, 2011

Related U.S. Application Data

(60) Provisional application No. 61/257,321, filed on Nov. 2, 2009, provisional application No. 61/298,820, filed on Jan. 27, 2010.

(51) Int. Cl.

| | |
|---|---|
| ***G08B 13/14*** | (2006.01) |
| *G08B 1/08* | (2006.01) |
| *G08B 21/00* | (2006.01) |
| *E05B 73/00* | (2006.01) |

(52) U.S. Cl.

CPC ..... *E05B 73/0017* (2013.01); *G08B 13/1445* (2013.01); *E05B 73/0029* (2013.01); *E05B 73/0041* (2013.01)

USPC ..... 340/568.1; 340/568.6; 340/539.11; 340/540; 70/15; 70/58

(58) Field of Classification Search

USPC ..... 340/539.11, 568.1, 568.6

See application file for complete search history.

(56) References Cited

U.S. PATENT DOCUMENTS

| | | | | |
|---|---|---|---|---|
| 4,086,795 | A * | 5/1978 | Foster et al. | 70/233 |
| 5,464,109 | A | 11/1995 | Greenwald | |
| 5,586,670 | A | 12/1996 | Greenwald | |
| 5,602,530 | A | 2/1997 | Holmgren | |

(Continued)

FOREIGN PATENT DOCUMENTS

| | | | |
|---|---|---|---|
| CN | 201439407 | U | 4/2010 |
| EP | 1 593 803 | A1 | 11/2005 |

(Continued)

OTHER PUBLICATIONS

Century Plastic & Electronic Co. Ltd., Bottle Top Tag (No. B008), Jan. 14, 2010, http://www.century-cn.com/ProductInfo.aspx?ID=1d0c4122-13bf-438.

(Continued)

*Primary Examiner* — Jack K Wang
(74) *Attorney, Agent, or Firm* — Nathaniel T. Quirk

(57) ABSTRACT

Various embodiments of the invention may be directed to a security device comprising a housing, a rotatable assembly, a locking assembly, and a cable. The rotatable assembly may include a plurality of locking teeth, a spool, and an engagement portion configured to facilitate rotation the rotatable assembly. The locking assembly may include biasing elements configured to apply a biasing force so that the locking assembly and the rotatable assembly may be configured in a locked position. Further, the locking assembly may include magnetically attractive elements configured to counteract the biasing force when a specifically configured key is applied to the housing of the security device. The security device may further include a security element, an alarm, and other components.

35 Claims, 21 Drawing Sheets

(56) References Cited

U.S. PATENT DOCUMENTS

| | | | | |
|---|---|---|---|---|
| 5,722,266 | A * | 3/1998 | Yeager et al. | 70/57 |
| 5,957,313 | A | 9/1999 | Bouan | |
| 6,604,643 | B1 | 8/2003 | Michael et al. | |
| 6,769,557 | B2 | 8/2004 | Michael et al. | |
| 6,793,081 | B1 | 9/2004 | Derman | |
| 6,822,567 | B2 | 11/2004 | Durbin | |
| 6,912,878 | B2 | 7/2005 | Belden, Jr. | |
| 7,004,340 | B2 | 2/2006 | Belden, Jr. | |
| 7,007,523 | B2 | 3/2006 | Belden, Jr. | |
| 7,100,783 | B2 | 9/2006 | Belden, Jr. | |
| 7,100,784 | B2 | 9/2006 | Belden, Jr. | |
| 7,259,674 | B2 | 8/2007 | Marsilio et al. | |
| 7,350,652 | B2 | 4/2008 | Belden, Jr. | |
| 7,350,653 | B2 | 4/2008 | Belden, Jr. | |
| 7,350,654 | B2 | 4/2008 | Belden, Jr. | |
| 7,350,655 | B2 | 4/2008 | Belden, Jr. | |
| 7,372,363 | B2 | 5/2008 | Durbin | |
| 7,397,375 | B2 | 7/2008 | Marsilio et al. | |
| 7,463,152 | B2 | 12/2008 | Marsilio et al. | |
| 7,486,190 | B2 | 2/2009 | Marsilio et al. | |
| 7,492,263 | B2 | 2/2009 | Marsilio et al. | |
| 7,492,264 | B2 | 2/2009 | Marsilio et al. | |
| 7,492,265 | B2 | 2/2009 | Marsilio et al. | |
| 7,498,944 | B2 | 3/2009 | Marsilio et al. | |
| 7,498,945 | B2 | 3/2009 | Marsilio et al. | |
| 7,570,161 | B2 | 8/2009 | Necchi | |
| 7,602,297 | B2 | 10/2009 | Marsilio et al. | |
| 7,685,860 | B2 | 3/2010 | Iwashita et al. | |
| D628,924 | S * | 12/2010 | Sayegh et al. | D10/106.93 |
| 8,044,806 | B2 * | 10/2011 | Sayegh | 340/572.9 |
| 8,087,269 | B2 * | 1/2012 | Conti et al. | 70/14 |
| 2005/0237205 | A1 | 10/2005 | Gorst | |
| 2007/0039360 | A1 * | 2/2007 | Fawcett et al. | 70/57.1 |
| 2007/0069529 | A1 | 3/2007 | Nilsson | |
| 2007/0146134 | A1 | 6/2007 | Belden et al. | |
| 2007/0163309 | A1 | 7/2007 | Fawcett et al. | |
| 2008/0169924 | A1 | 7/2008 | Belden | |
| 2008/0236209 | A1 * | 10/2008 | Conti et al. | 70/18 |
| 2009/0145872 | A1 | 6/2009 | Pagneux | |
| 2009/0152230 | A1 | 6/2009 | Belden, Jr. | |
| 2009/0184121 | A1 | 7/2009 | Hulin | |
| 2009/0212001 | A1 | 8/2009 | Clemente | |
| 2010/0052907 | A1 * | 3/2010 | Shannon et al. | 340/568.6 |
| 2011/0283750 | A1 | 11/2011 | Will | |

FOREIGN PATENT DOCUMENTS

| | | | |
|---|---|---|---|
| WO | WO 97/14125 | A1 | 4/1997 |
| WO | WO 2008/142713 | A1 | 11/2008 |
| WO | WO 2009/103179 | A1 | 8/2009 |
| WO | WO 2011/137330 | | 11/2011 |
| WO | WO 2011/143529 | | 11/2011 |

OTHER PUBLICATIONS

Century Plastic & Electronic Co. Ltd., Bottle Top Tag (No. B008), Jan. 14, 2010, http://www.century-cn.com/Picture/Product/uploads/2006/200610249.

* cited by examiner

ADJUSTABLE DUAL LOOP CABLE SECURITY DEVICE

CROSS-REFERENCE TO RELATED APPLICATIONS

This application claims the benefit of priority to U.S. Provisional Application No. 61/257,321, which was entitled "Adjustable Cable Wrap Security Device" and was filed Nov. 2, 2009, and further claims priority to U.S. Provisional Application No. 61/298,820, which was entitled "Security Device" as was filed Jan. 27, 2010. The contents of each of the above provisional applications are hereby incorporated by reference in their entirety.

BACKGROUND OF THE INVENTION

1. Field of the Invention

Embodiments of the invention relate to security devices used to protect merchandise or other objects and, more particularly, to security devices having one or more adjustable cables used to secure objects of various shapes and sizes to the security device.

2. Description of Related Art

Electronic article surveillance (EAS) systems are often used to deter and detect shoplifting. Typically, an EAS security system includes an EAS element, a transmitter, a receiver, and an alarm. The EAS element is attached to an article of merchandise. The transmitter and the receiver are positioned at the exit of a retail establishment and configured to establish a detection zone in which a consumer must pass through as he or she exits the retail establishment. The transmitter is configured to send signals through a detection zone. When an EAS element enters the detection zone, the EAS element responds and creates a signal or a change or disturbance in the original signal transmitted by the transmitter, which is detectable by the receiver. Upon detection of the EAS element, the alarm is triggered in order to notify store personnel that someone is trying to exit the retail establishment with merchandise that has an attached and active EAS element.

In an EAS system, it is the actual EAS element that is being detected and not the merchandise itself. Therefore, an EAS system can be circumvented by removing the EAS element from the merchandise. To prevent the unauthorized removal of the EAS element, security devices have been developed. A typical security device is configured to house the EAS element and attach the EAS element to the merchandise in a manner that limits the likelihood that a consumer or a would-be thief could readily remove the EAS element from the merchandise.

Applicant has identified a number of deficiencies and problems associated with the design and operation of conventional security devices. Through applied effort, ingenuity, and innovation, Applicant has solved many of these identified problems by developing a solution that is embodied by the present invention, which is described in detail below.

BRIEF SUMMARY OF THE INVENTION

Embodiments of the present invention improve the prior art by, among other things, providing a security device structured for attachment to objects (e.g., retail products) such as those having a flanged end and/or an irregular shape. According to one embodiment, the security device includes a housing, a cable having first and second ends that are rigidly anchored within the housing, and a rotatable assembly. The rotatable assembly includes a capture portion that is adapted to engage the cable between the first and second cable ends. The capture portion, thus, defines two cable loops. The first cable loop being defined between the first cable end and the capture portion, and the second cable loop being defined between the second cable end and the capture portion. The security device may also include a locking mechanism that, when engaged in a locked configuration, is configured to prevent rotation of the rotatable assembly in one direction (i.e., a loosening direction) while allowing rotation in an opposite direction (i.e., a tightening direction). When the locking mechanism is disengaged, in an unlocked configuration, the rotatable assembly is free to rotate in either direction.

In other embodiments, the security device may include a housing defining a cavity for receiving at least part of a secured object and a perimeter rim extending at least partly around the cavity. The first and second cable loops may be positioned within or proximate the perimeter rim of the housing to help shield the loops from cutting or tampering by would-be thieves. The security device may include a collar disposed within the cavity for supporting the cable loops in a protected position. In one embodiment, the collar may define flanges that are configured to move inwardly, i.e., towards the center of the cavity, as the first and second cable loops are tightened thereby tightening the flanges against the object to be secured. In other embodiments, such flanges may not be used as the cable loops themselves operate to secure the object.

In one embodiment, the rotatable assembly includes a spool defining the capture portion and the first and second loops are tightened by rotating the rotatable assembly such that portions of the first and second loops are wound onto the spool. In another embodiment, the rotatable assembly defines a plurality of locking teeth that are configured for engagement by a locking surface of the locking mechanism when the security device is disposed in a locked configuration.

In yet another embodiment, the security device may include a housing that is configured to protect an alarm module and at least partially define an audible alarm channel. The alarm channel is disposed in audio communication proximity to the alarm module and may further define an anti-tamper portion at one end and an exit gap at an opposite end. In one embodiment, the anti-tamper portion is structured to reduce tampering with or disabling of the alarm module through the exit gap as discussed in greater detail below.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
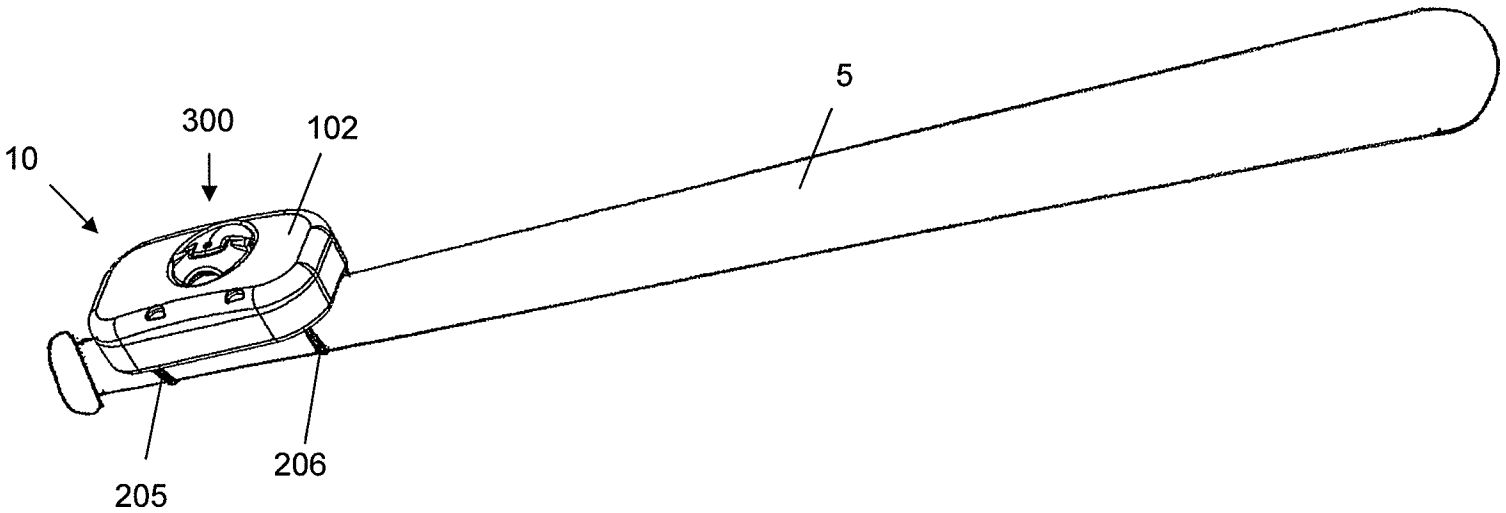
FIG. 1 illustrates a perspective view of a security device attached to an irregularly shaped object in accordance with one embodiment of the invention.
Figure 2:
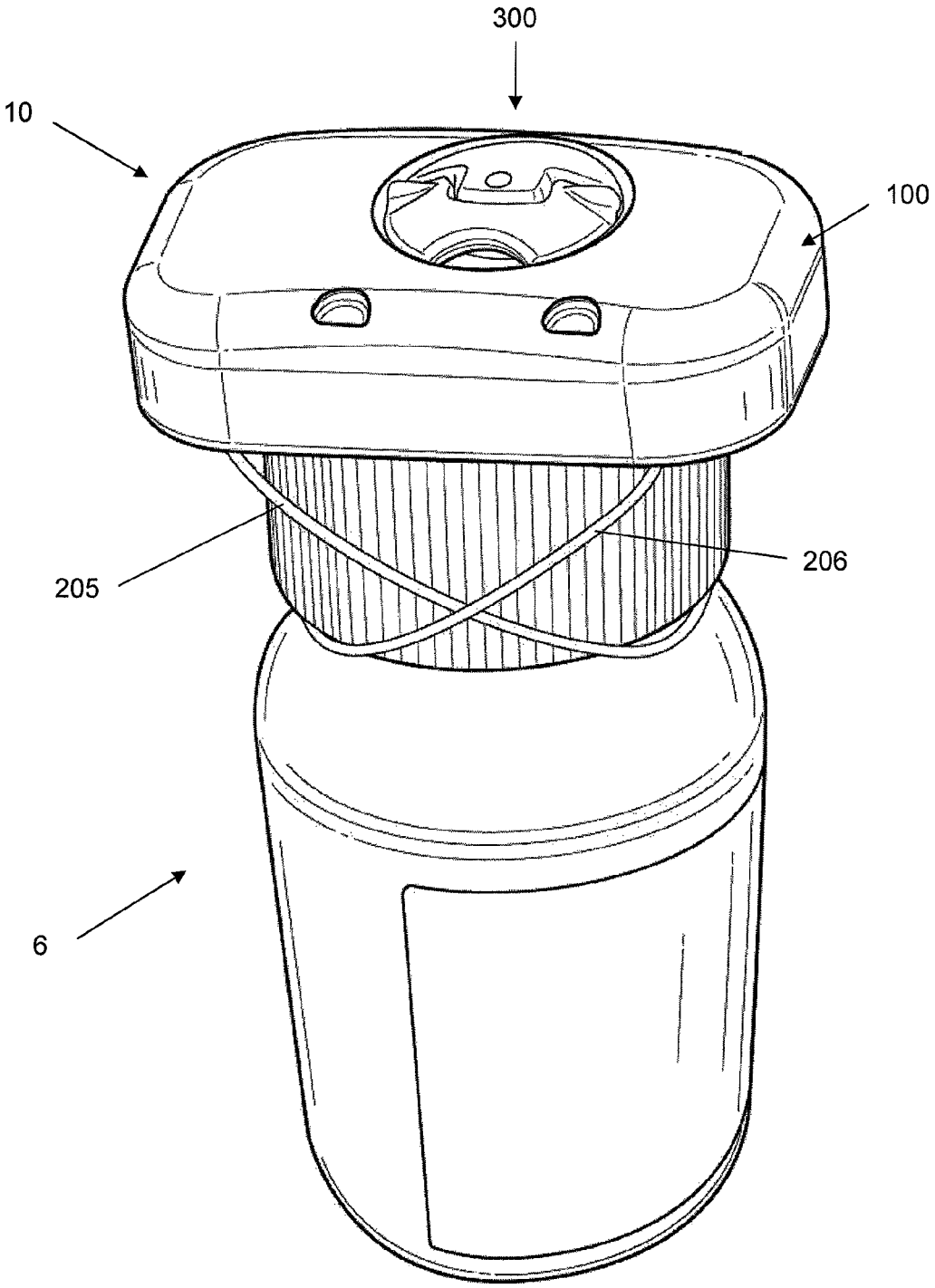
FIG. 2 illustrates a perspective view of the security device of FIG. 1 attached to a different object, i.e., a pill bottle, according to one embodiment of the invention.

Embodiments of the present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout. The terms top, bottom, side, up, down, upwards, downwards, vertical, horizontal, and the like as used below do not imply a required limitation in all embodiments of the present invention, but rather are used herein to help describe relative direction or orientation in exemplary embodiments illustrated in the figures.

Various embodiments of the present invention provide a security device configured to be adjustable for engaging various sizes and configuration of goods, retail products, or other objects. The security device may be configured to be secured to merchandise or other objects and configured with other systems (e.g., EAS systems, RFID systems, etc.) to detect unauthorized removal of, or tampering with, a secured object. The security device may further include a security element (e.g., EAS element, RFID transponder, etc.) and one or more alarm features.

As explained in detail below, embodiments of the present invention provide a security device comprising a rotatable assembly, a locking assembly, and a cable. The rotatable assembly is configured to either wind or unwind the cable, thus, tightening or loosening the cable around a secured object. In some embodiments, the rotatable assembly defines a spool having a capture portion (e.g., aperture, slot, etc.) that receives a portion of the cable. Rotation of the rotatable assembly and spool in a tightening direction causes the cable to be engaged proximate the capture portion and wound onto the spool. The locking assembly is configured to selectively lock the rotatable assembly, such that the cable cannot be loosened from the secured object without first disengaging the locking assembly.

In some embodiments, such as those depicted in FIGS. 1-9, the security device may be configured to define two cable loops that may be differently sized to secure objects (or portions thereof) having an irregular shape. In other embodiments, such as those depicted in FIGS. 10-20, the security device may define two cable loops that are positioned within the perimeter rim of a protective housing to deter tampering with or cutting of the cable.

Turning to the embodiment illustrated in FIGS. 1-9, the depicted security device 10 comprises a rotatable assembly 300 (shown for example in FIG. 6), a cable 200, a locking assembly 400 (shown for example in FIG. 8), and a housing 100. As will be apparent to one of ordinary skill in the art in view of this disclosure, the depicted security device 10 is configured to define two loops 205, 206 that may be differently sized and, thus, advantageously configured, to secure objects having irregular shapes such as the baseball bat 5 depicted in FIG. 1, the pill bottle 6 depicted in FIG. 2, or other valuable products.

Figure 3:
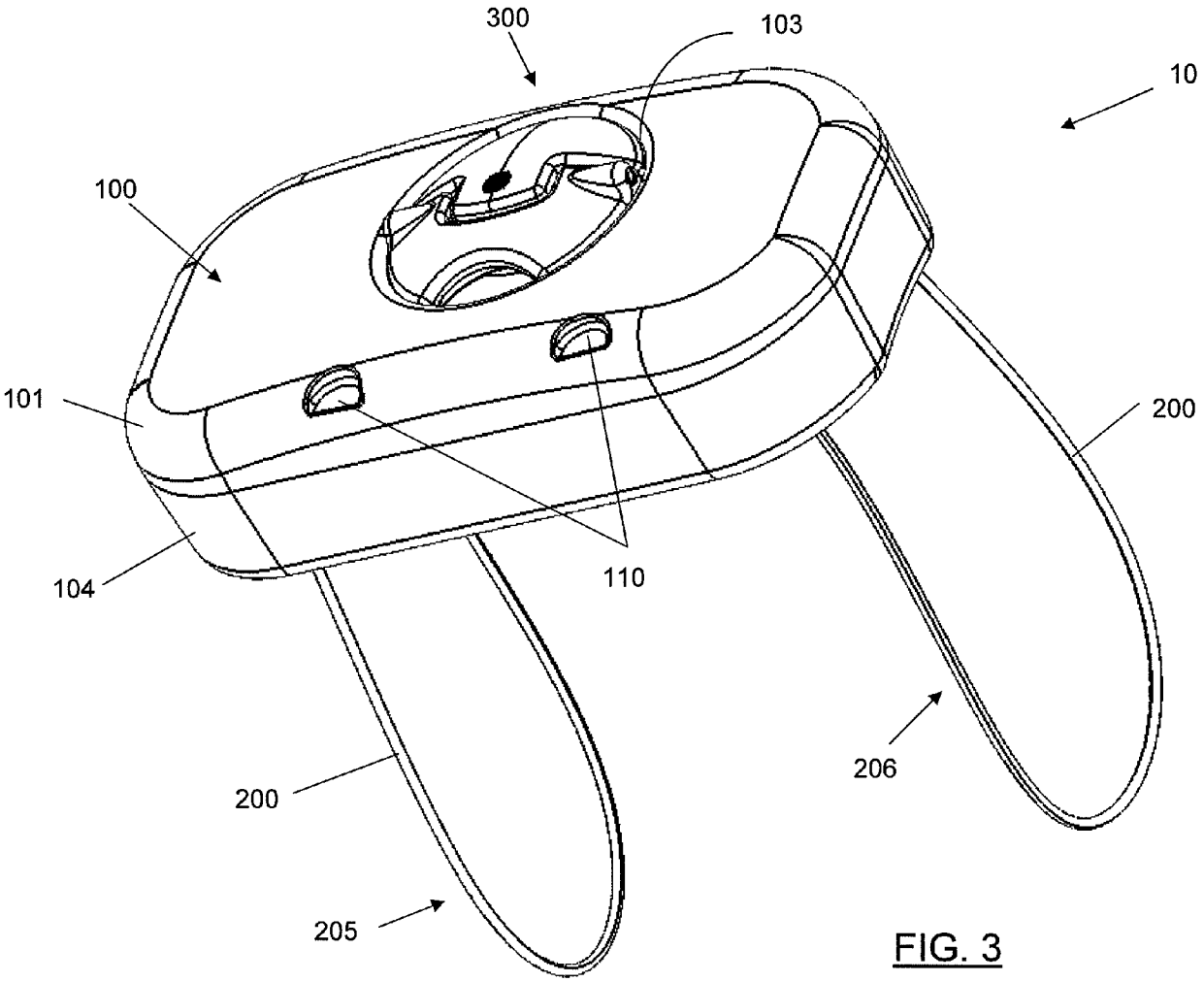
FIG. 3 illustrates a top perspective view of the security device of FIG. 1.

FIG. 3 is a perspective view of the security device 10 shown without a secured object attached thereto. The housing 100 of the depicted security device 10 is configured to at least partly enclose the rotatable assembly 300, the locking assembly, a security element, and one or more alarm modules. The housing 100 also functions to anchor, at least partly, the cable 200. The depicted housing 100 is comprised of an outer (i.e., positioned away from a secured object) portion 101 and an inner (i.e., positioned proximate the secured object) portion 104 that are secured together, for example, by adhesive, weld, or one or more fasteners. The depicted housing 100 defines key locating indentations 110 and an outer opening 103 for receiving at least part of the rotatable assembly 300 therethrough as will be discussed in greater detail below.

Housings 100 structured according to various embodiments may be made of durable plastic material that resists breakage such as high density polyethylene (HDPE), acrylonitrile butadiene styrene (ABS), polycarbonate, or other strong and lightweight materials. In one embodiment, the housing 100 may be constructed of a material that is at least strong enough to withstand an impact having a force sufficient to break a bottle (e.g., a plastic or glass bottle) to which the security device is attached. In this way, the security device may be configured to provide a benefit denial type of functionality.

Figure 4:
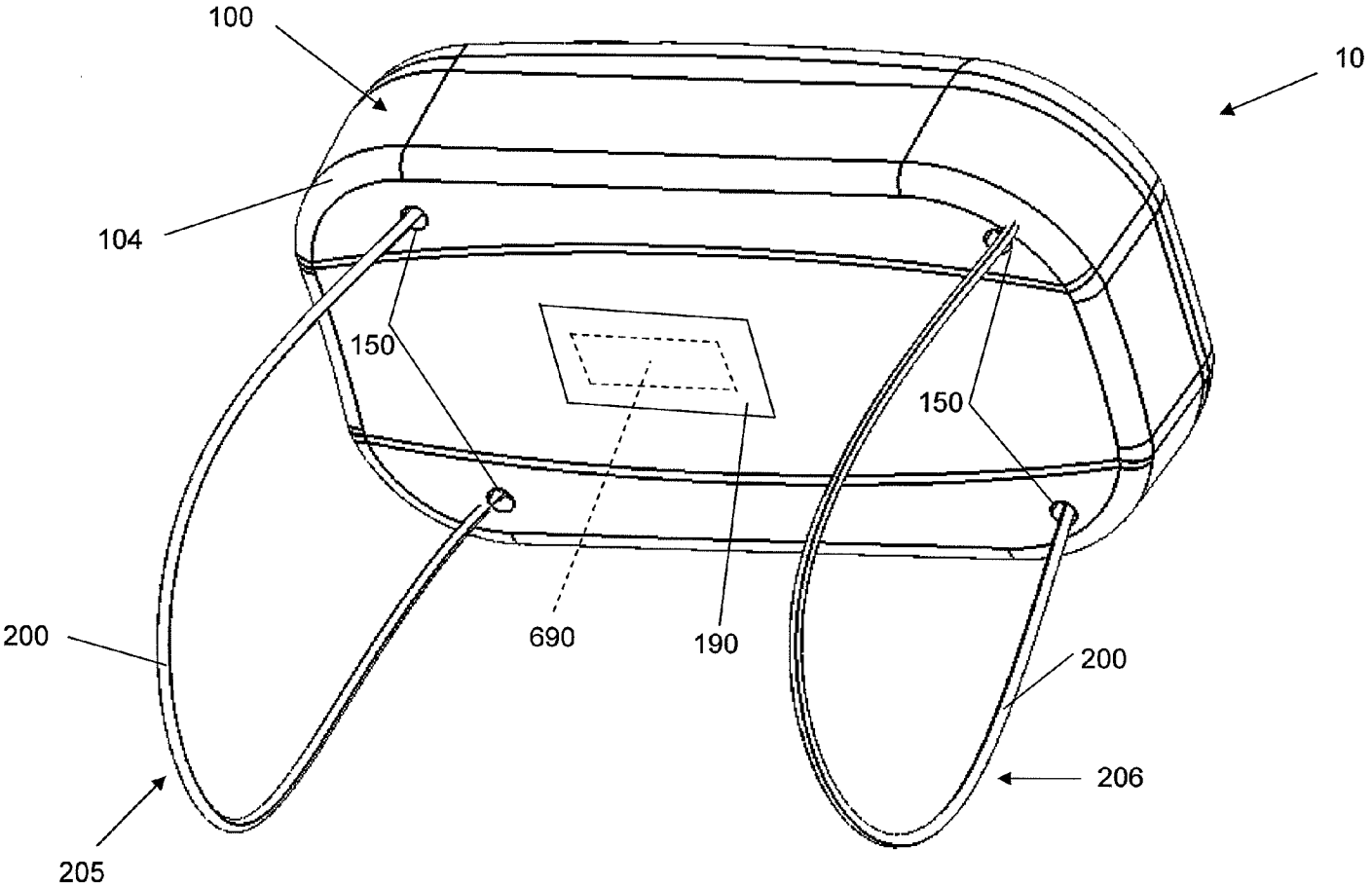
FIG. 4 illustrates a bottom perspective view of the security device of FIG. 1.

FIG. 4 is a bottom perspective view of the security device 10 shown in FIG. 3 and again, the security device 10 is depicted without a secured object attached thereto. The cable 200 extends through cable openings 150 defined by the inner portion 104 of the security device. Further, the cable defines portions of two securing loops 205, 206, which are configured to secure an object to the security device. The inner portion 104 of the depicted embodiment further defines a battery door 190, which provides access to a replaceable battery 690 positioned within the housing. In alternate embodiments, as will be apparent to one of ordinary skill in the art, the depicted battery door 190 may not be needed.

Figure 5:
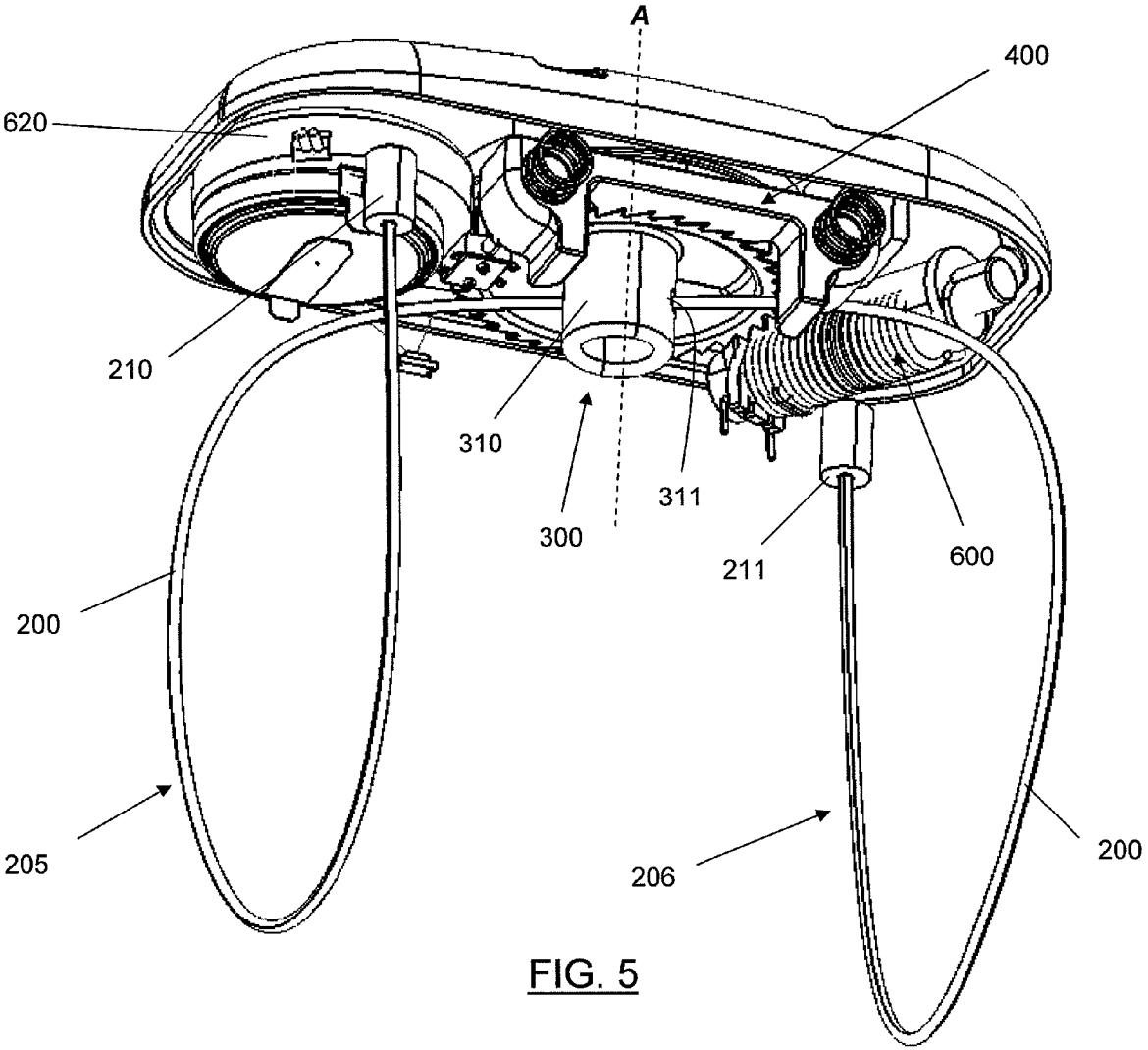
FIG. 5 depicts a bottom perspective view of the security device of FIG. 1, with the inner portion of the housing and a printed circuit board removed for illustration purposes, according to one embodiment of the invention.

FIG. 5 is a bottom perspective view of the security device according to the present embodiment with portions removed for ease of explanation. FIG. 5 depicts the rotatable assembly 300, the locking assembly 400, the cable 200, a piezoelectric speaker 620, and a security element 600. In the depicted embodiment, a single continuous cable 200 is routed from a first cable terminal 210, through a capture portion 311 defined by a spool 310 of the rotatable assembly 300, to a second cable terminal 211. One skilled in the art will appreciate that the capture portion may be defined as a recess, a notch, a cavity, a slot, a hook, a flange, or any other feature configured to engage a portion of the cable during winding onto the spool.

In the depicted embodiment, the cable 200 is fixed within the housing at the first and second cable terminals 210, 211, but is freely movable through the capture portion 311 of the spool 310 when the rotatable assembly 300 is disposed in an unwound position as shown. The first securing loop 205 of the cable 200 is defined between the first cable terminal 210 and the capture portion 311 of the spool 310 while the second cable loop 206 is defined between the second cable terminal 211 and the capture portion 311 of the spool 310. Said differently, the capture portion 311 of the spool 310 defines the transition between the first and second securing loops 205, 206 of the cable 200. It is important to note, however, that portions of the cable 200 may be allocated to either the first securing loop 205 or the second securing loop 206 by sliding the cable 200 through the capture portion 311 of the spool 310 in order to adjust the respective sizes of the first and second securing loops 205, 206.

In various embodiments, the spool 310 may be rotated about an axis A for winding a portion of the cable 200 onto the spool to tighten the first and second securing loops 205, 206. In the depicted embodiment, the first and second cable terminals 210, 211 are oriented in a vertical manner to facilitate routing of the cable 200 (i.e., orientation of the first and second securing loops 205, 206) along a desired path. Other embodiments of the present invention may comprise a first and second cable terminals oriented in a substantially horizontal position to assist routing the cable along a different desired path. As will be apparent to one of ordinary skill in the art in view of this disclosure, the first and second cable terminals 210, 211 are firmly affixed to the cable and are anchored within the housing to ensure that the cable ends are not easily removed from the housing by a would-be thief. In some embodiments, the first and second terminals 210, 211 may define an electrically conductive shoe or sleeve such that removal of the cable from one of the sleeves could be sensed by the device thereby provoking an alarm event.

Figure 6:
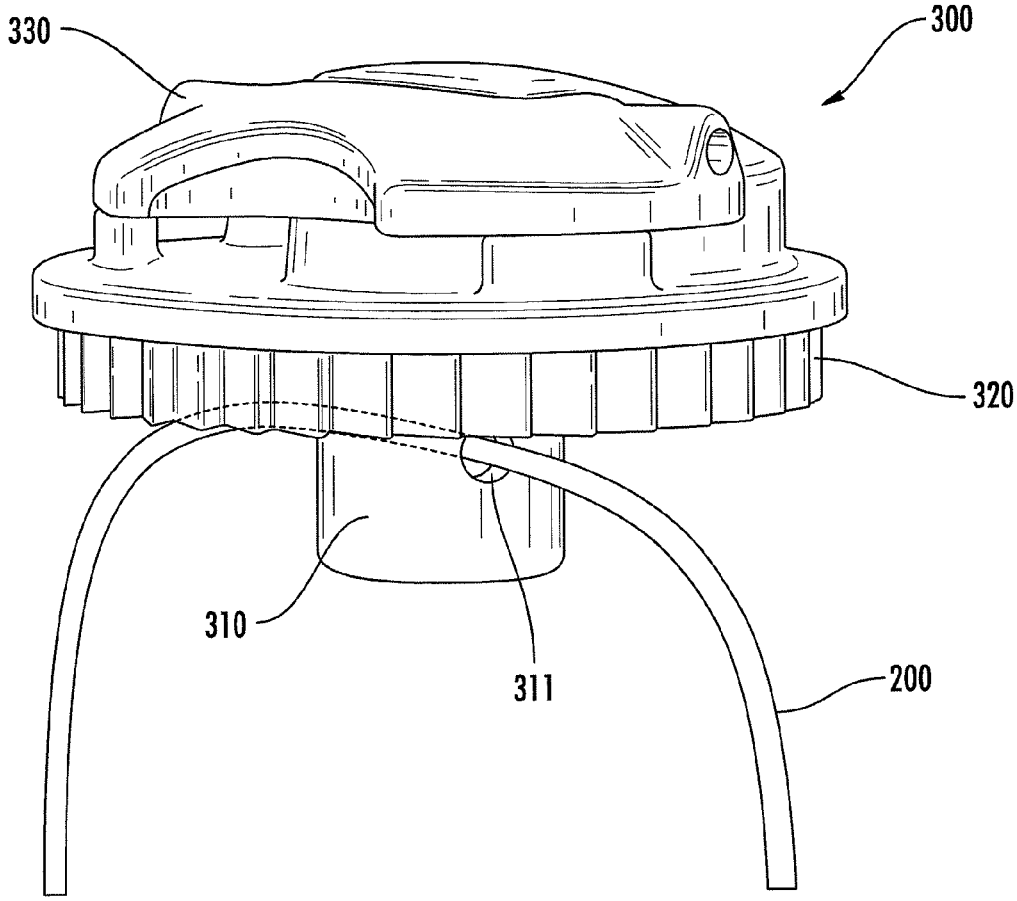
FIG. 6 illustrates a perspective view of a rotatable assembly and a cable each removed from the security device of FIG. 1 and disposed in an unwound position according to one embodiment of the invention.
Figure 7:
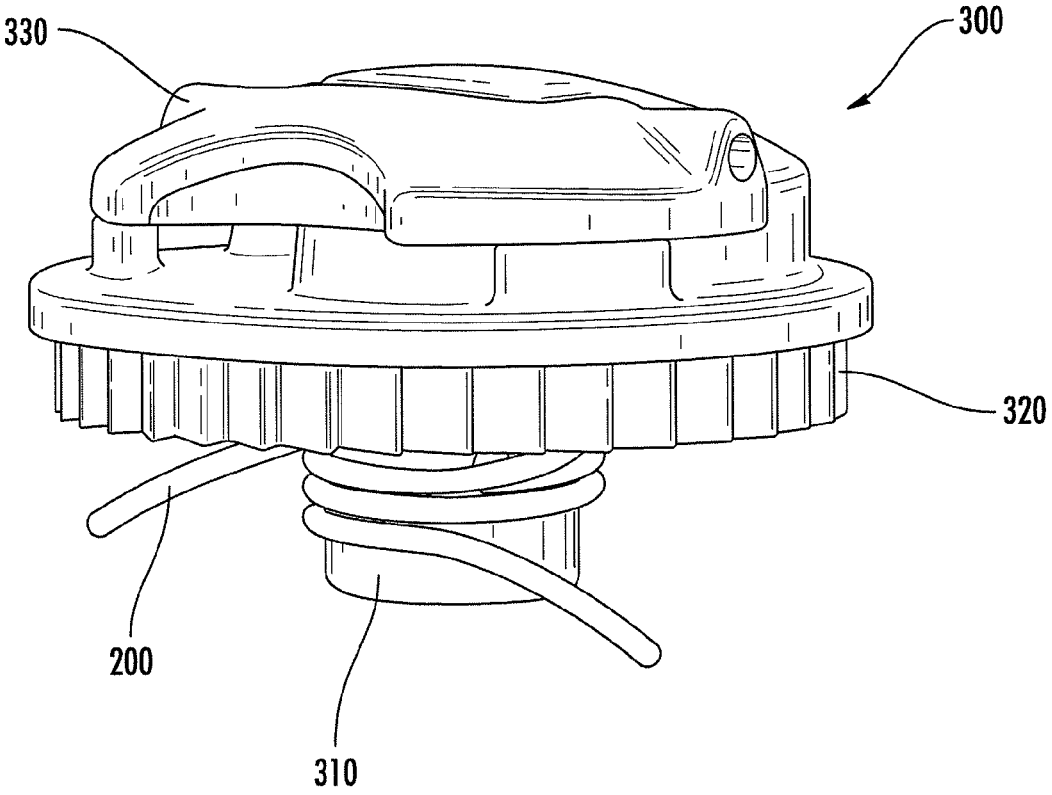
FIG. 7 illustrates a perspective view of the rotatable assembly and the cable of FIG. 6 disposed in a partially wound position according to one embodiment of the invention.

FIGS. 6 and 7 illustrate a perspective view of the rotatable assembly 300 according to the present embodiment of the invention. FIG. 6 illustrates the rotatable assembly 300 in an unwound position, while FIG. 7 shows the rotatable assembly in a partially wound position, i.e., where the rotatable assembly 300 has been rotated in a tightening direction. The rotatable assembly 300 comprises a spool 310, a plurality of locking teeth 320, and an engagement portion 330. As was discussed above, the spool 310 defines a capture portion 311 that receives a portion of the cable 200 for engaging the cable 200 during winding of the cable 200 onto the spool 310.

In the depicted embodiment, the engagement portion 330 comprises a flip-up handle that allows a user to easily rotate the rotatable assembly. However, in alternate embodiments, the engagement portion 330 of the rotatable assembly 300 may be differently configured so long as a user remains able to grasp and rotate the rotatable assembly 300 via the engagement portion 330. For instance, in some embodiments, the engagement portion 330 may be the top body of the rotatable assembly 300 simply contoured to define a few perimeter ribs, finger-hold cavities, or the like.

Figure 8:
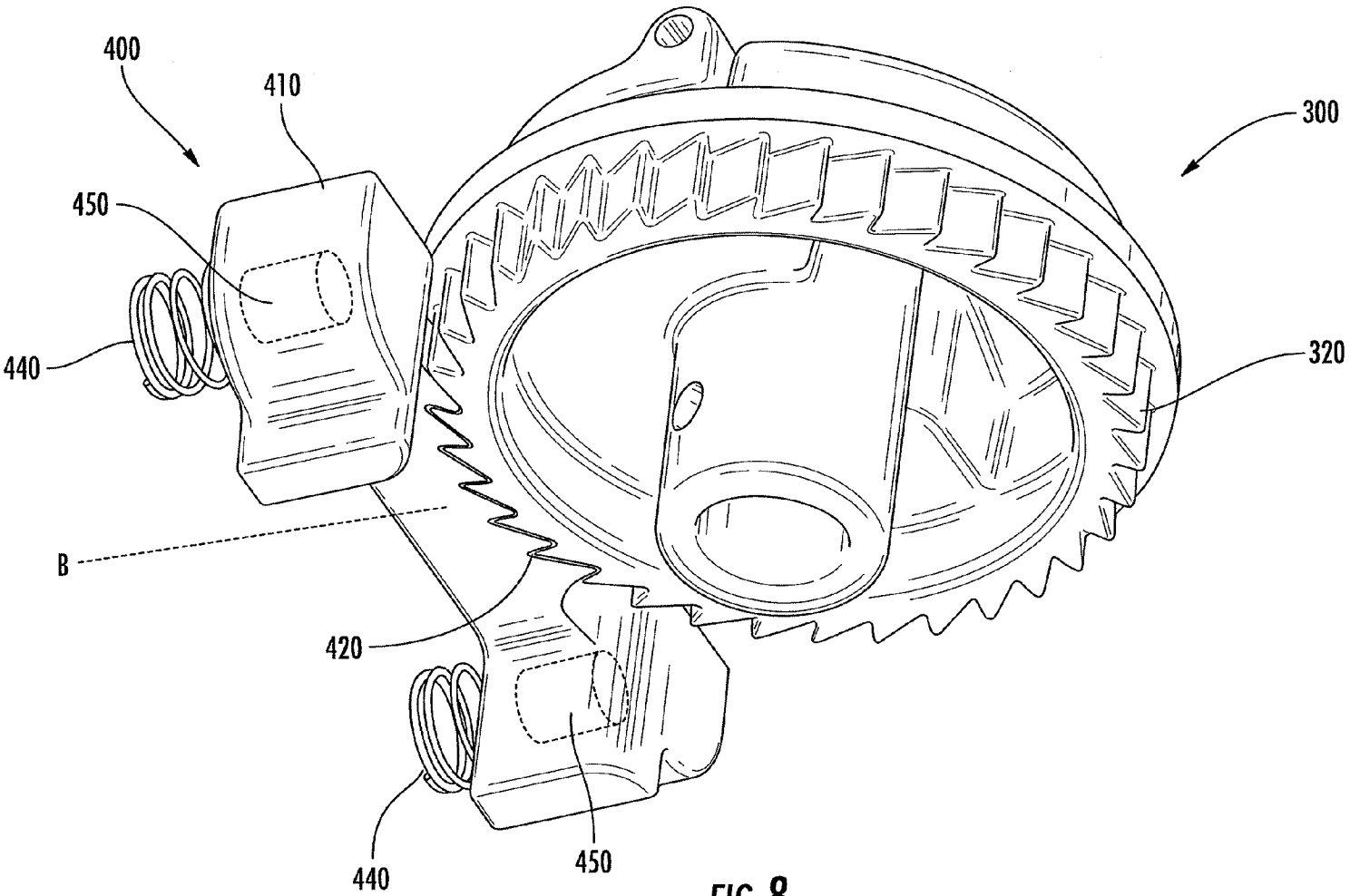
FIG. 8 illustrates a bottom perspective view of a locking assembly and the rotatable assembly of the security device of FIG. 1 disposed in a locked position according to one embodiment of the invention.
Figure 9:
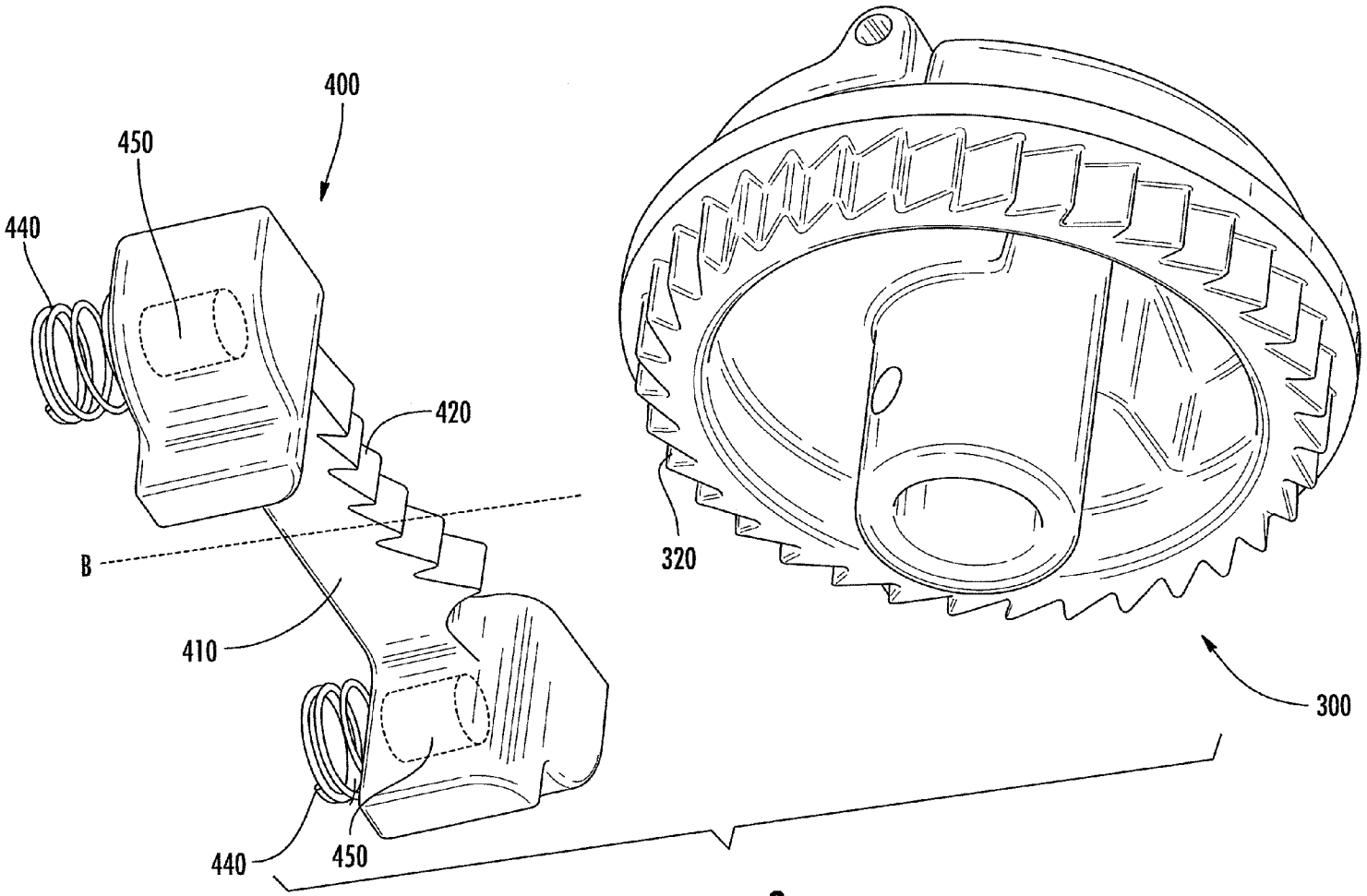
FIG. 9 illustrates a bottom perspective view of the locking assembly and the rotatable assembly of FIG. 8 disposed in an unlocked position according to an embodiment of the invention.

FIGS. 8 and 9 are perspective views of the rotatable assembly 300 and the locking assembly 400 of the security device 10. Specifically, FIG. 8 illustrates the rotatable assembly 300 and the locking assembly 400 disposed in a locked position, while FIG. 9 depicts the rotatable assembly 300 and the locking assembly 400 disposed in an unlocked position. The depicted locking assembly 400 comprises a sliding element 410, a locking surface 420, magnetically attractive elements 450, and biasing elements 440. The sliding element 410 is configured to move towards and away from the rotatable assembly along axis B. The locking surface 420 of the sliding element is configured to engage the plurality of locking teeth 320 of the rotatable assembly 300 when the locking assembly is disposed in the locked position. The locking surface 420 of the sliding element is configured to not engage the plurality of locking teeth 320 of the rotatable assembly 300 when the locking assembly is disposed in the unlocked position.

As will be apparent to one of ordinary skill in the art, the locking surface 420 of the sliding element 410 and the locking teeth 320 of the rotatable assembly 300 are reciprocally configured to allow only one way rotation (i.e., in a cable tightening direction) of the rotatable assembly 300 when the locking assembly 400 is disposed in the locked position. Therefore, when the locking assembly 400 is in the locked position, the security device 10 is configured to allow user-tightening of the cable loops 205, 206 (i.e., by rotating the rotatable assembly) while preventing loosening of the cable loops 205, 206, thus, reducing the likelihood that a would-be thief could remove the security device from the object.

The depicted sliding element 410 is configured to be biased towards the locked or engaged position by biasing elements 440. The biasing elements 440 may be made from coil springs, as shown, or other similar biasing structures that are adapted to drive the sliding element 410 toward the rotatable assembly 300. In the depicted embodiment, although not shown, the biasing elements 440 are supported by the housing so as to apply a biasing force to the sliding element 410.

The depicted magnetically attractive elements 450 are positioned proximate each biasing element 440 to aid in overcoming the biasing force applied by the biasing elements 440. In one embodiment, the magnetically attractive elements 450 may be fixed within the sliding element, for example, using an adhesive or a friction fit arrangement, such that as the magnetically attractive elements are magnetically attracted away from the rotatable assembly (perhaps by an externally applied magnetic key), the sliding element 410 moves to an unlocked position as shown in FIG. 9.

In one embodiment, the magnetically attractive elements are configured such that the sliding element 410 is only movable by an applied magnetic force when that magnetic force has a certain strength or particular orientation relative to the sliding element 410 or magnetically attractive elements 450. For example, the sliding element 410 may be movable to the unlocked, or disengaged, position by a specifically configured magnetic key (not shown) that is selectively placed next to the key locating indentations 110 shown in FIG. 3.

In another embodiment, the magnetically attractive elements 450 are positioned on opposite ends of the sliding element 410 and the sliding element 410 is loosely supported within the housing such that both magnetically attractive elements 450 must be attracted towards the unlocked position in order to disengage the locking assembly 400. Should a single magnet be used in an attempt to move only one end of the sliding element 410 towards the unlocked position (e.g., forcing the sliding element into a jack knife-type position), the locking surface 420 located near the other (i.e., unattracted) end of the sliding element 410 would remain engaged with the locking teeth 320, thus, maintaining the locking assembly 410 in the engaged position and preventing unwinding of the cable 200. Additionally, in another embodiment, the biasing elements 440 may be selected to have a sufficiently high compression strength such that a relatively high magnetic force is required for attracting each of the two magnetically attractive elements 450. Accordingly, given the relatively close positioning of the magnetically attractive elements, it may be difficult for a would-be thief to reproduce a counterfeit key that supports two magnets of sufficient strength in close enough proximity to one another due to the strong repulsive force that the magnets would have on each other. In other words, a would-be-thief would not be able to hold two high-powered magnets close enough to each other to be able to disengage the locking assembly 400. In this way, the requirement of a specifically configured key minimizes the likelihood that a consumer or would-be thief would able to move the sliding element 410 using one or more conventional or common magnets.

Figure 10:
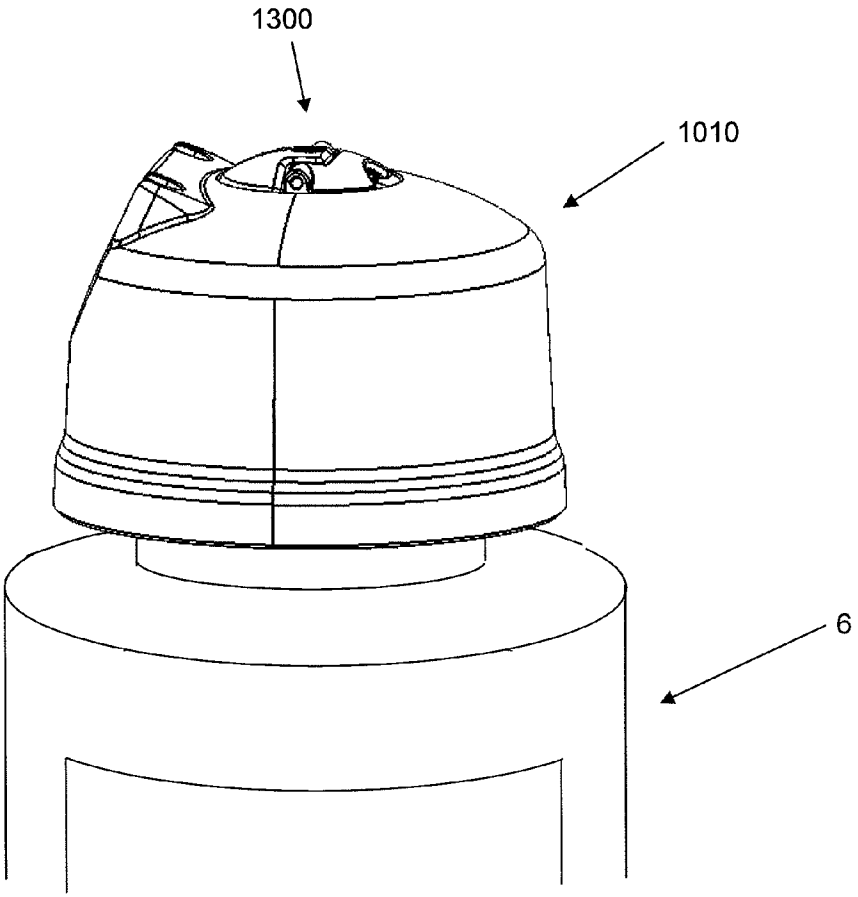
FIG. 10 illustrates a perspective view of a security device attached to a pill bottle in accordance with yet another embodiment of the invention.

FIG. 10 illustrates another embodiment of the present invention securing a pill bottle 6 or other container to the security device 1010. The depicted embodiment provides a security device 1010 configured to define two cable loops (not shown) positioned within a perimeter rim of a protective housing to deter tampering or cutting of the cable. As shown collectively in FIGS. 10-16, the depicted security device 1010 comprises a housing 1100, a cable 1200 (shown in FIG. 11), a rotatable assembly 1300, and a locking assembly 1400 (shown in FIG. 14).

Figure 11:
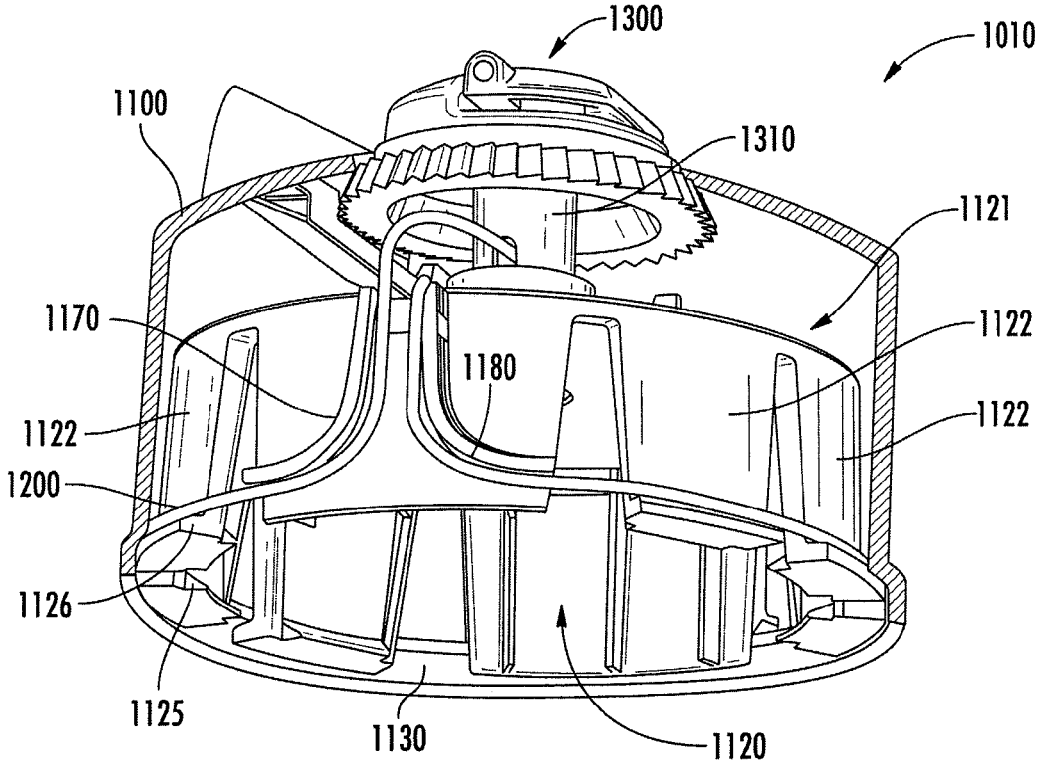
FIG. 11 illustrates a perspective, partially sectioned, view of the security device of FIG. 10.

FIG. 11 is a perspective view of the security device 1010 with a cross-section of the housing 1100 removed for ease of explanation. The housing 1100 is configured to at least partly enclose the cable 1200, the rotatable assembly 1300, the locking assembly 1400, a security element 1600 (shown in FIG. 12), and one or more alarm modules. The housing 1100 defines a cavity 1120 therein and a perimeter rim 1130 that extends around the cavity 1120. In the present embodiment, the security device comprises a collar 1121 disposed within the cavity 1120 defined by the housing 1100. The collar 1121 defines a plurality of flanges 1122. The flanges 1122 comprise outer tabs 1126 configured to capture the cable 1200 between the flanges 1122 and the perimeter rim 1130 of the housing 1100. The flanges 1122 are further configured to support and maintain a selected position for the cable 1200 respective to the collar 1121. In one embodiment, the flanges 1122 may also define inner tabs 1125 that extend inwardly toward the center of the cavity 1120 and operate to capture a ridge, flange, rib, lid, or other similar element associated with a secured object.

As shown in FIG. 11, the collar 1121 further defines first and second shoulders 1170, 1180. The shoulders 1170, 1180 defined curved channels as shown to limit stress on the cable (i.e., avoid kinks or sharp turns) and ease movement of the cable 1200 when the cable 1200 is wound onto or removed from the spool 1310. The collar 1121 and shoulders 1170, 1180 may collectively operate to reduce the likelihood of the cable binding, wearing prematurely, or being tampered with.

Figure 12:
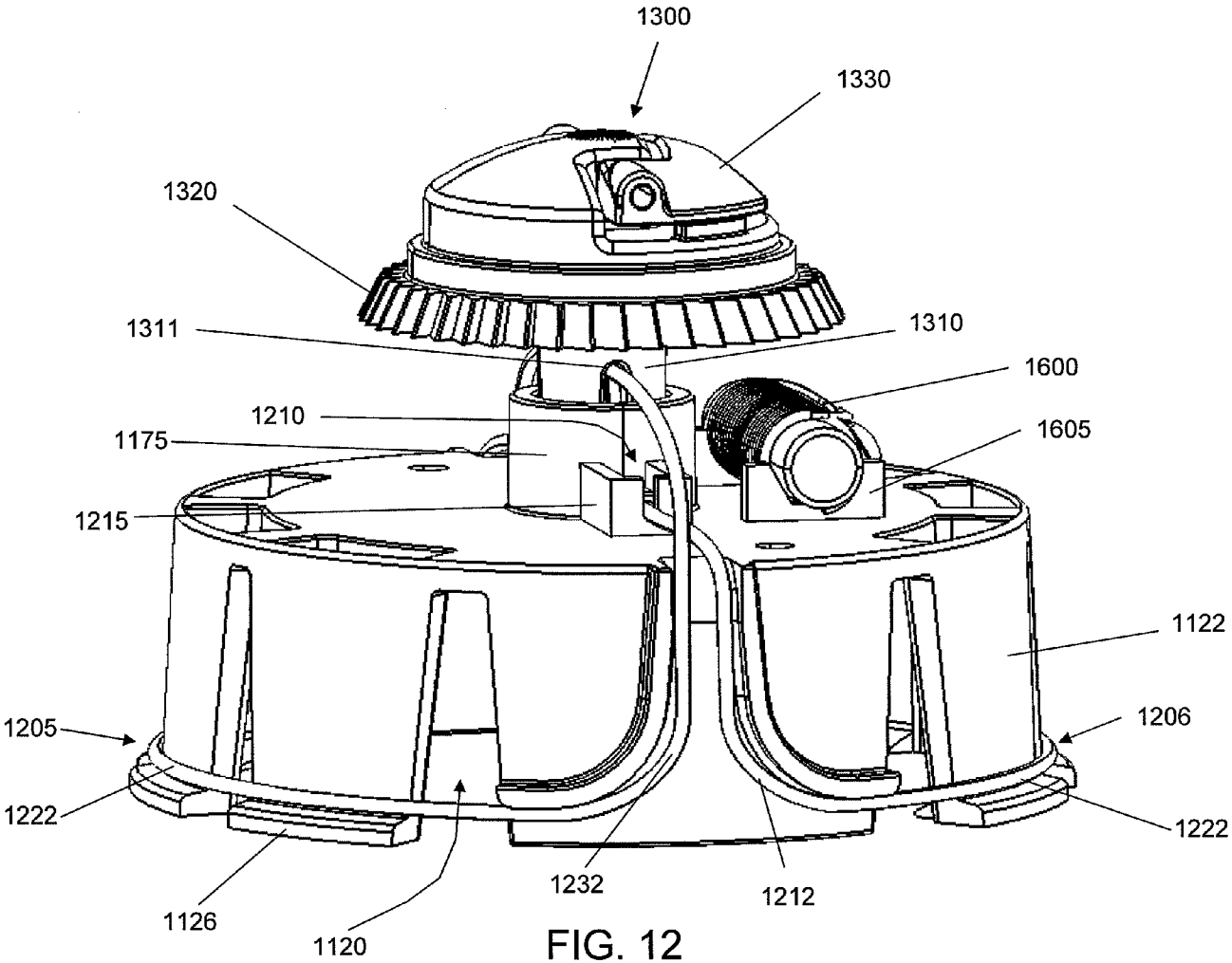
FIG. 12 illustrates a perspective view of a rotatable assembly and a collar of the security device of FIG. 10, disposed in an unwound position, according to one embodiment of the invention.

In one embodiment, as shown in FIG. 12, the collar may comprise a mount 1605 for supporting a security element 1600. In addition, the collar may define anchor structures 1215 (e.g., pockets or similar structures) for anchoring a first cable terminal 1210 and a second cable terminal (not shown), thus, fixing the location of the cable terminals relative to the collar of the security device. Alternatively, in other embodiments, the cable terminals may be retained by a portion of the housing of the security device, thus, fixing the location of the terminals within the housing. Finally, the collar 1121 may define spool support sleeve 1175 that is adapted to receive and engage the spool 1310 of the rotatable assembly 1300 such that the rotatable assembly 1300 may be rotated relative to the collar 1121 as discussed in greater detail below.

Figure 13:
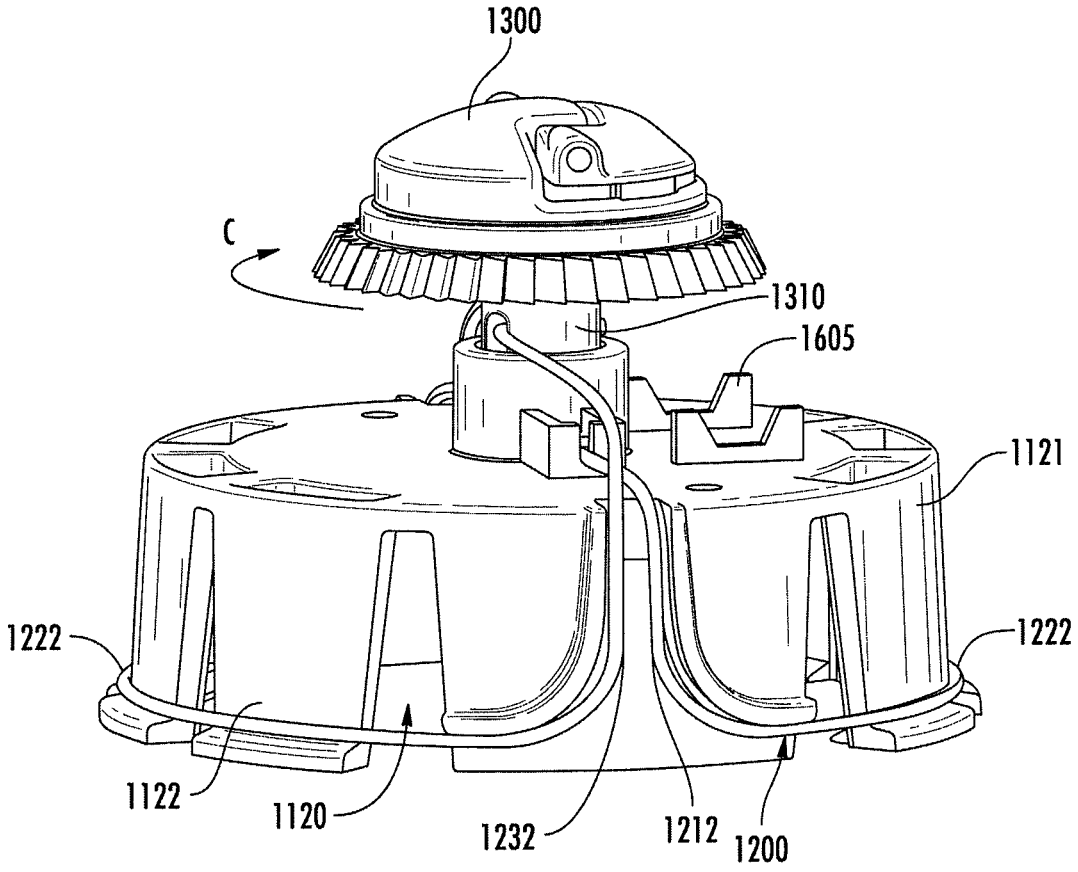
FIG. 13 illustrates a perspective view of a rotatable assembly and a collar of the security device of FIG. 10, disposed in a slightly wound position, according to one embodiment of the invention.

FIGS. 12 and 13 provide perspective views of the security device 1010 with portions of the embodiment removed for ease of explanation. Specifically, FIG. 12 depicts the rotatable assembly 1300 supported by the collar 1121 but disposed in an unwound position. FIG. 13 illustrates the rotatable assembly 1300 supported by the collar 1121 but disposed in a wound or tightened position.

The depicted rotatable assembly 1300 comprises a spool 1310, a plurality of locking teeth 1320, and an engagement portion 1330. In one embodiment, the cable 1200 is routed from a first cable terminal 1210, around one side of the collar 1121 proximate the flanges 1122, through a capture portion 1311 defined by the spool 1310, around the other side of the collar 1121 proximate the flanges 1122, and to a second cable terminal (not shown). In this regard, two cable loops 1205, 1206 (shown in FIG. 12) are defined in a manner similar to the embodiment depicted above in connection with FIGS. 1-6. The first securing loop 1205 of the cable 1200 is defined between the first cable terminal 1210 and the capture portion 1311 of the spool 1310 while the second cable loop 1206 is defined between the second cable terminal (not shown) and the capture portion 1311 of the spool 1310. Said differently, the capture portion 1311 of the spool 1310 defines the transition between the first and second securing loops 1205, 1206 of the cable 1200.

As will be apparent to one of ordinary skill in the art, in the depicted embodiment, the cable 1200 is routed in a particular manner around the collar 1121. The depicted cable 1200 defines perimeter cable portions 1222, terminal cable portions 1212, and winding cable portions 1232. The perimeter cable portions 1222 are configured to extend at least partly around the base of the collar 1121 proximate the flanges 1122 and the perimeter rim 1130 of the housing 1100 (shown in FIG. 11). The terminal cable portions 1212 are portions of the cable defined between the perimeter cable portions 1222 and the first and second cable terminals. The winding cable portions 1232 are defined between the perimeter cable portions 1222 and the capture portion 1311 of the spool 1310. The winding cable portions 1232 are configured to at least partly wind onto the spool when the rotatable assembly 1300 is turned in the winding direction.

Although the collar 1121 shown in FIGS. 11-13 comprises six flanges 1122, one skilled in the art will appreciate any number of flanges may be included with such collar. Further, the number of flanges 1122 in one embodiment may depend, at least in part, on the shape or configuration of the object to be secured. The collar 1121 may be constructed of a resilient material that is flexible enough to allow the flanges 1122 to flex inwardly (i.e., toward an object positioned within the cavity) when the rotatable assembly 1300 is rotated in the winding direction as shown in FIG. 13 thereby tightening the cable 1200. Further, the flanges 1122 may be resilient enough such that they are biased outwardly (i.e., away from the object positioned within the cavity) to return to an original position when the rotatable assembly is in the unwound position and the cable 1200 is thereby loosened. In one embodiment, the flanges 1122 may be configured to apply a sufficient outward biasing force to the cable 1200, such that the flanges 1122 bias the rotatable assembly 1300 toward the unwound position by driving the perimeter portions 1222 of the cable 1200 towards the perimeter rim of the housing.

Returning to FIG. 10, the security device attaches to a pill bottle 6, such that a top portion of the article pill bottle may be inserted into the cavity 1120 of the security device 1010 when the rotatable assembly 1300 is in an unwound position. The top portion of the pill bottle 6 may include a flange defining a first diameter that is larger than a second diameter defined by a neck portion. The term "diameter" is meant to refer to a cross-sectional dimension such as a width, thickness, etc., and is not meant to be limited to products having a circular cross-section profile. Rather, the term "diameter" or "differing diameters" may be used to refer to various shapes, for example bottles or other products that define a neck portion having a hexagonal shape, a square shape, a circular shape, and/or a triangular shape, etc.

Once the top portion of the pill bottle 6 or other object is inserted, the rotatable assembly 1300 may be rotated in a tightening direction from the unwound or first position to the tightened position. Rotation of the rotatable assembly 1300 causes rotation of the spool 1310 such that the capture portion 1311 of the spool 1310 engages the cable 1200 and the cable 1200 is wound onto the spool 1310. Such winding of the cable 1200 causes the perimeter portions 1222 of the cable to retract thereby imparting a tightening force to the flanges 1122 such that the flanges 1122 move inwardly towards the secured object. In one embodiment, for example, such action forces the flanges 1122 to retract to a degree that inner tabs 1125 of the flanges 1122 enclose and secure the neck portion of depicted pill bottle 6. Said differently, the flanges 1122, which originally defined a first object engagement diameter (i.e., the largest object diameter around which the flanges might be secured based on a given wound level for the rotatable assembly), may be tightened to define a tightened object engagement diameter, which is smaller than the first object diameter. In various embodiments, as discussed in detail below, the security device includes a locking assembly that prevents loosening of the cable and outward movement of the flanges when disposed in a locked configuration.

Figure 14:
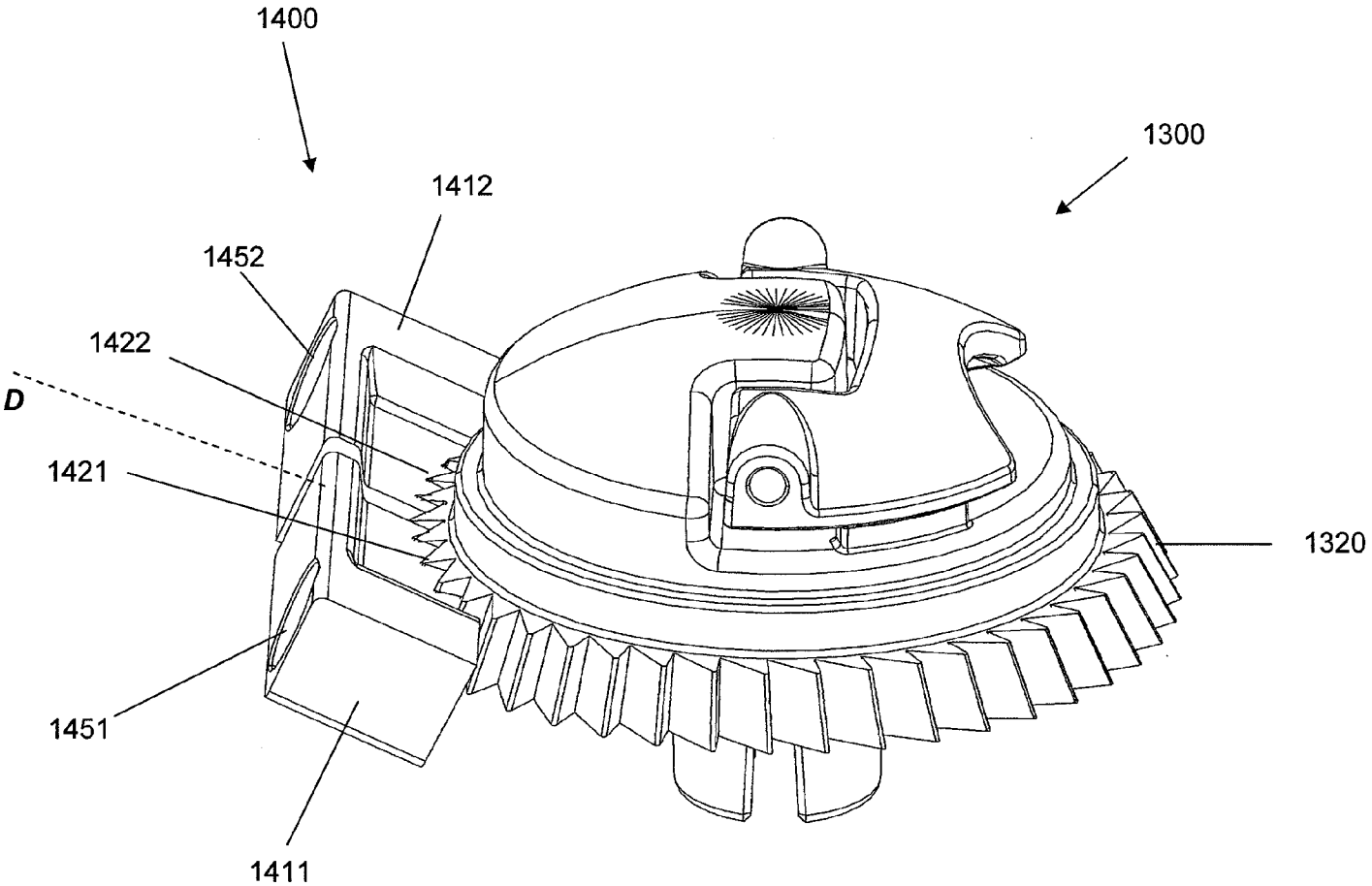
FIG. 14 illustrates a perspective view of a rotatable assembly and a locking assembly of the security device of FIG. 10, disposed in a locked position, according to one embodiment of the invention.
Figure 15:
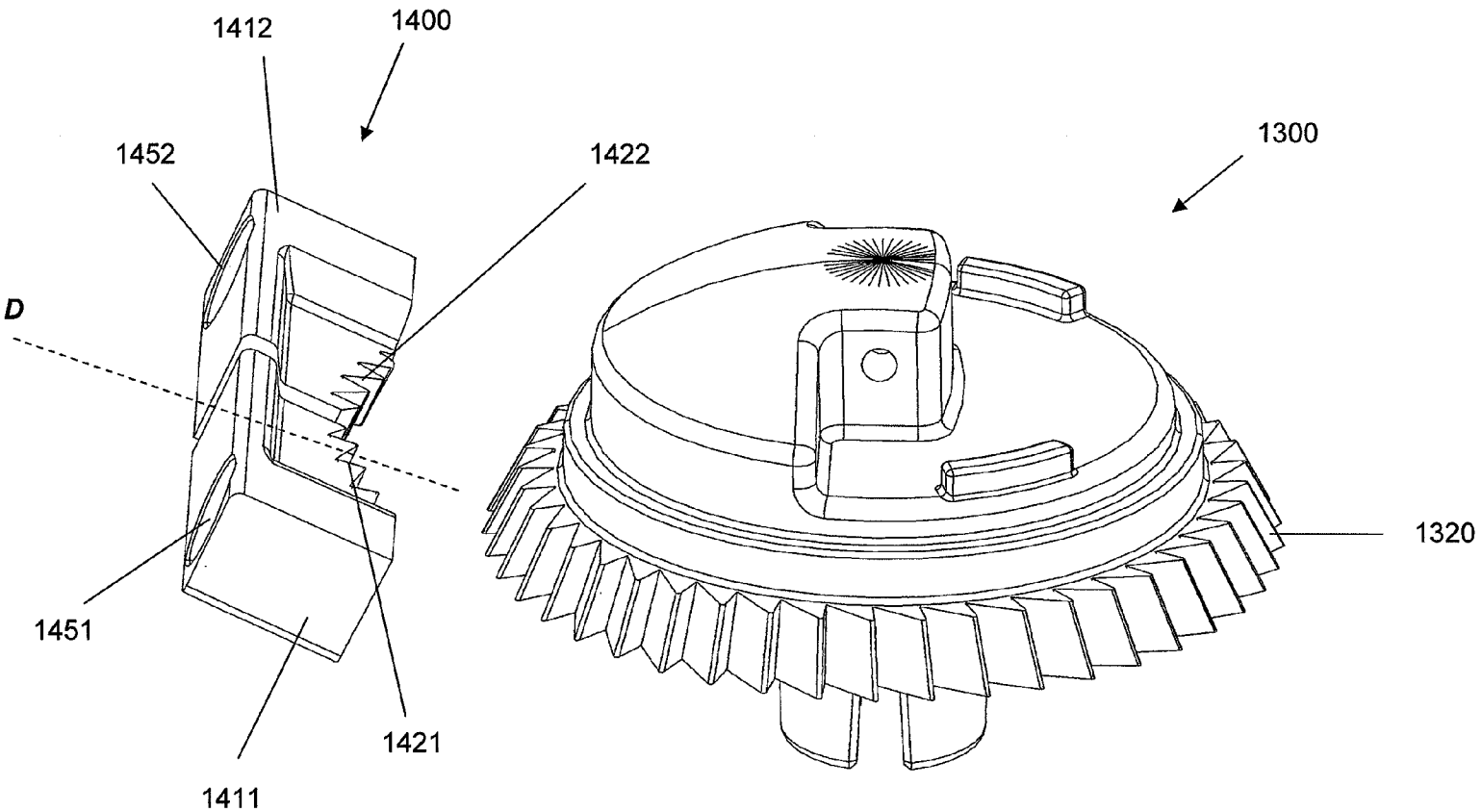
FIG. 15 illustrates a perspective view of a rotatable assembly and a locking assembly of the security device of FIG. 10, disposed in an unlocked position, according to one embodiment of the invention.
Figure 16:
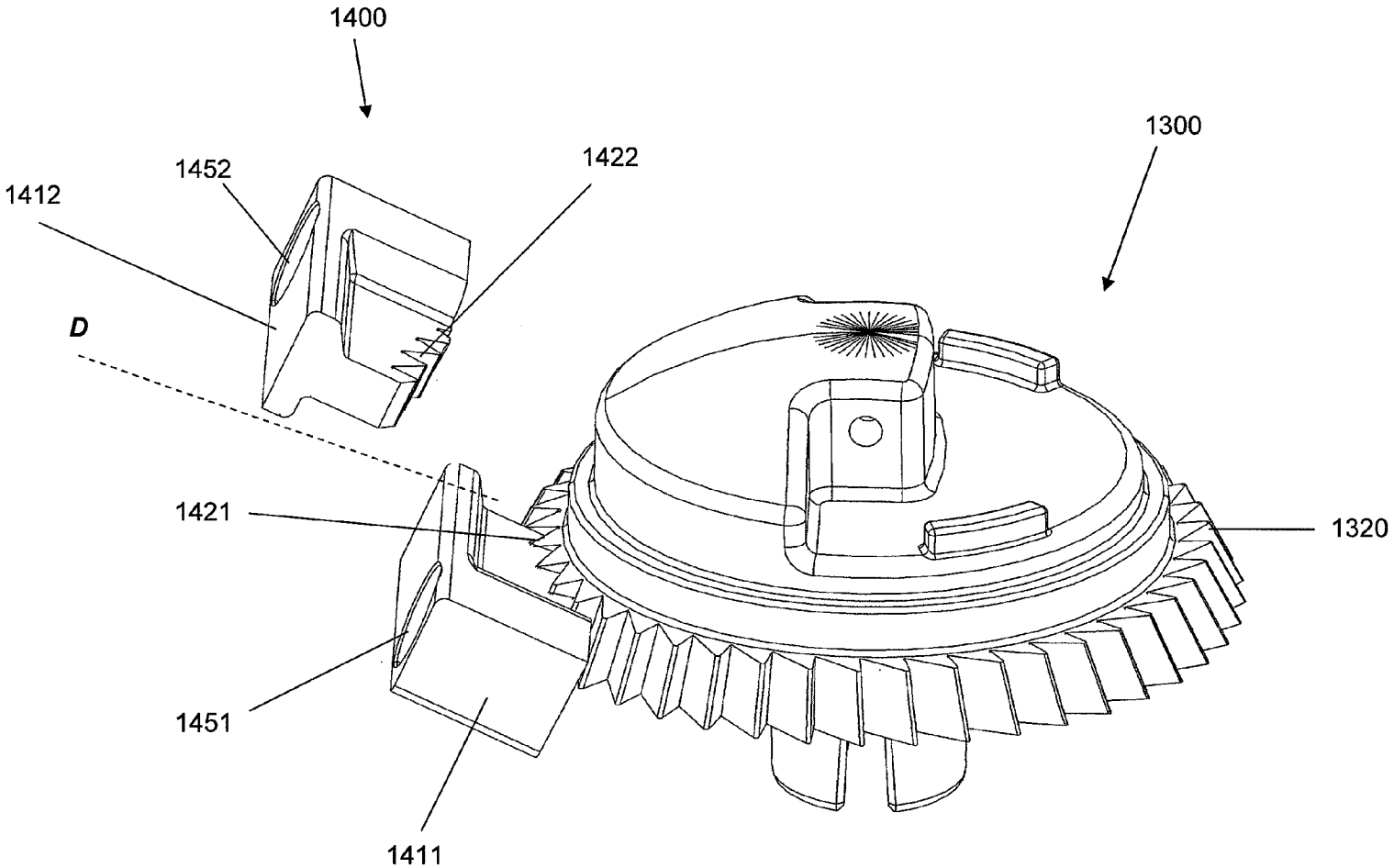
FIG. 16 illustrates a perspective view of a rotatable assembly and a locking assembly of the security device of FIG. 10, disposed in a partially unlocked position, according to one embodiment of the invention.

FIGS. 14-16 are perspective views of a rotatable assembly 1300 and a locking assembly 1400 for a security device structured in accordance with one embodiment of the invention. The depicted locking assembly 1400 comprises a first sliding element 1411 and a second sliding element 1412. The first sliding element 1411 defines a first locking surface 1421, while the second sliding element 1412 defines a second locking surface 1422. The locking assembly 1400 further comprises a first magnetically attractive element 1451, a second magnetically attractive element 1452, and biasing elements such as coil springs (not shown).

The depicted first and second sliding elements 1411, 1412 are configured to move towards and away from the rotatable assembly 1300 along axis D. As the first and second sliding elements 1411, 1412 move towards the rotatable assembly 1400, perhaps in response to a biasing force applied by a corresponding biasing element, the first and second locking surfaces 1421, 1422 engage the plurality of locking teeth 1320. The first and second locking surfaces 1421, 1422 and locking teeth 1320 are configured such that when either of the first or second locking surfaces 1421, 1422 engage the locking teeth 1320, this engagement prevents relative rotational movement between the locking surfaces and the locking teeth in one direction while allowing relative rotational movement between the locking surfaces and the locking teeth in the other direction.

In various embodiments, the first and second sliding elements 1411, 1412 are biased towards the locked or engaged position shown in FIG. 14 by biasing elements. Like the previous embodiments, the biasing elements may be coil springs supported between the first and second sliding elements and the housing. In one embodiment, the first and second magnetically attractive elements 1451, 1452 are positioned proximate each biasing element to aid in overcoming the force exerted by the biasing elements. Application of a magnetic key (not shown) that is specifically configured to produce two closely positioned, but focused, magnetic fields, may pull the first and second magnetically attractive elements toward the key, and thus disengage or unlock the first and second sliding element from the rotatable assembly. Notably, application of a key or a magnet configured to produce a single magnetic field may not properly disengage both sliding elements 1411, 1412. For example, as illustrated in FIG. 16, a single applied magnetic filed may cause the second sliding element 1412 to be disengaged from the rotatable assembly 1300, while the first sliding element 1411 remains locked. Said differently, a would-be thief would not be able to disengage or unlock both sliding elements 1411, 1412 with a single magnetic field. Further, as was noted above in connection with other embodiments, the close positioning of the first and second magnetically attractive elements 1451, 1452 may make it difficult for a would-be thief to use two magnets having sufficient strength to disengage both sliding elements.

FIGS. 17-20 illustrate another embodiment of the present invention. The depicted embodiment provides a security device 2010 configured to define two cable loops 2205, 2206 positioned within a perimeter rim of a protective housing to deter tampering or cutting of the cable. As shown collectively in FIGS. 17-20, the depicted security device comprises a housing 2100, a cable 2200, a rotatable assembly 2300, and a locking assembly 2400.

Figure 17:
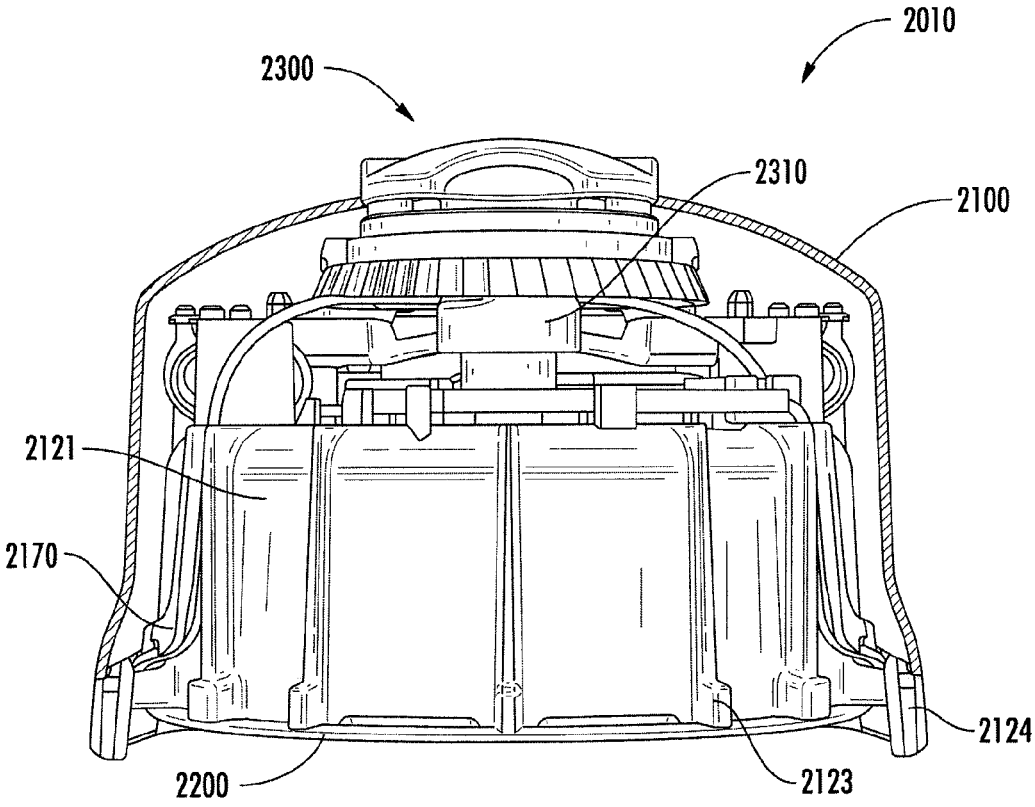
FIG. 17 is a partial section view of a security device structured in accordance with another embodiment of the invention.
Figure 18A:
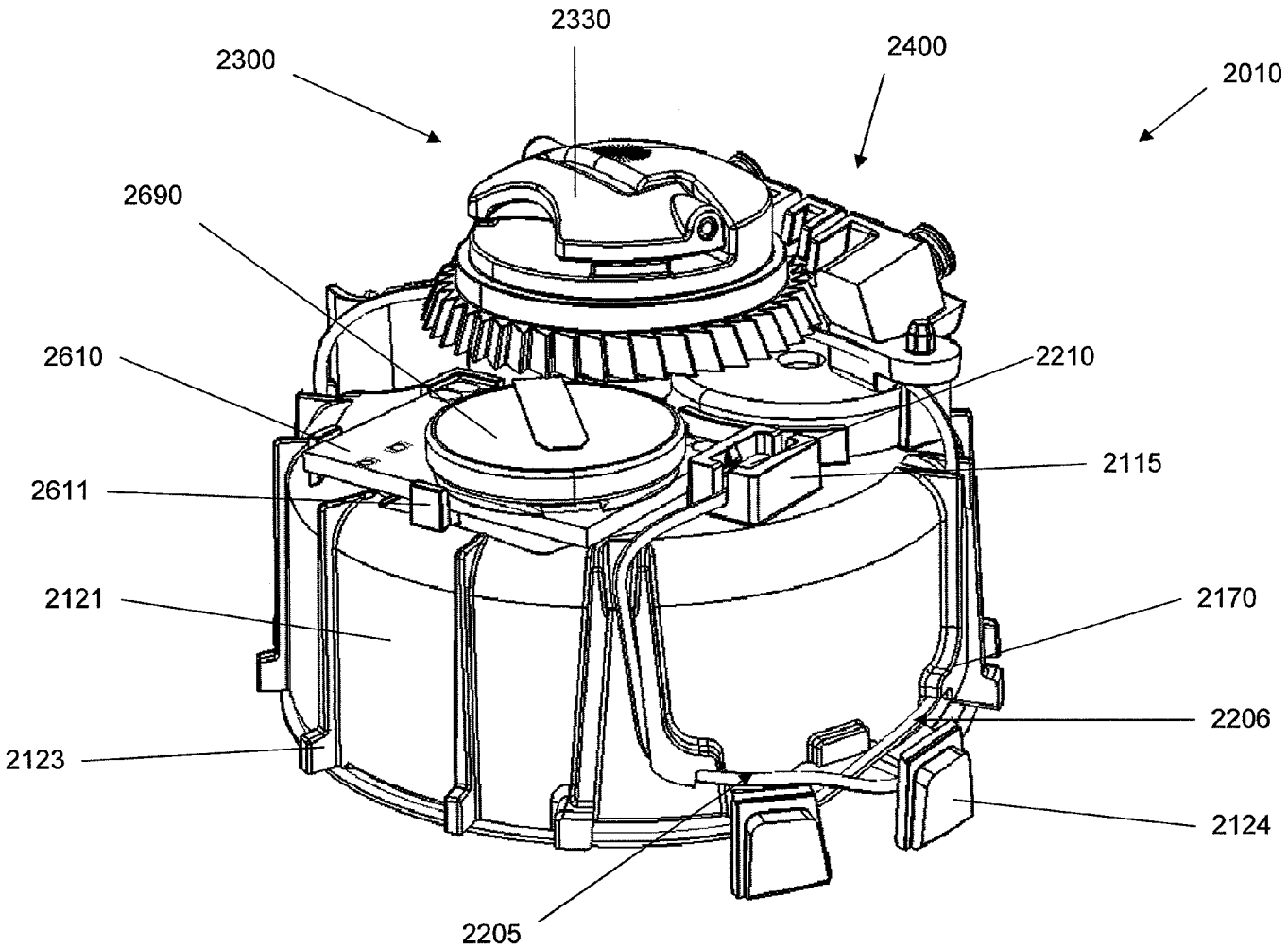
FIG. 18A is a perspective view of the security device of FIG. 17 with the housing removed for illustration purposes.
Figure 18B:
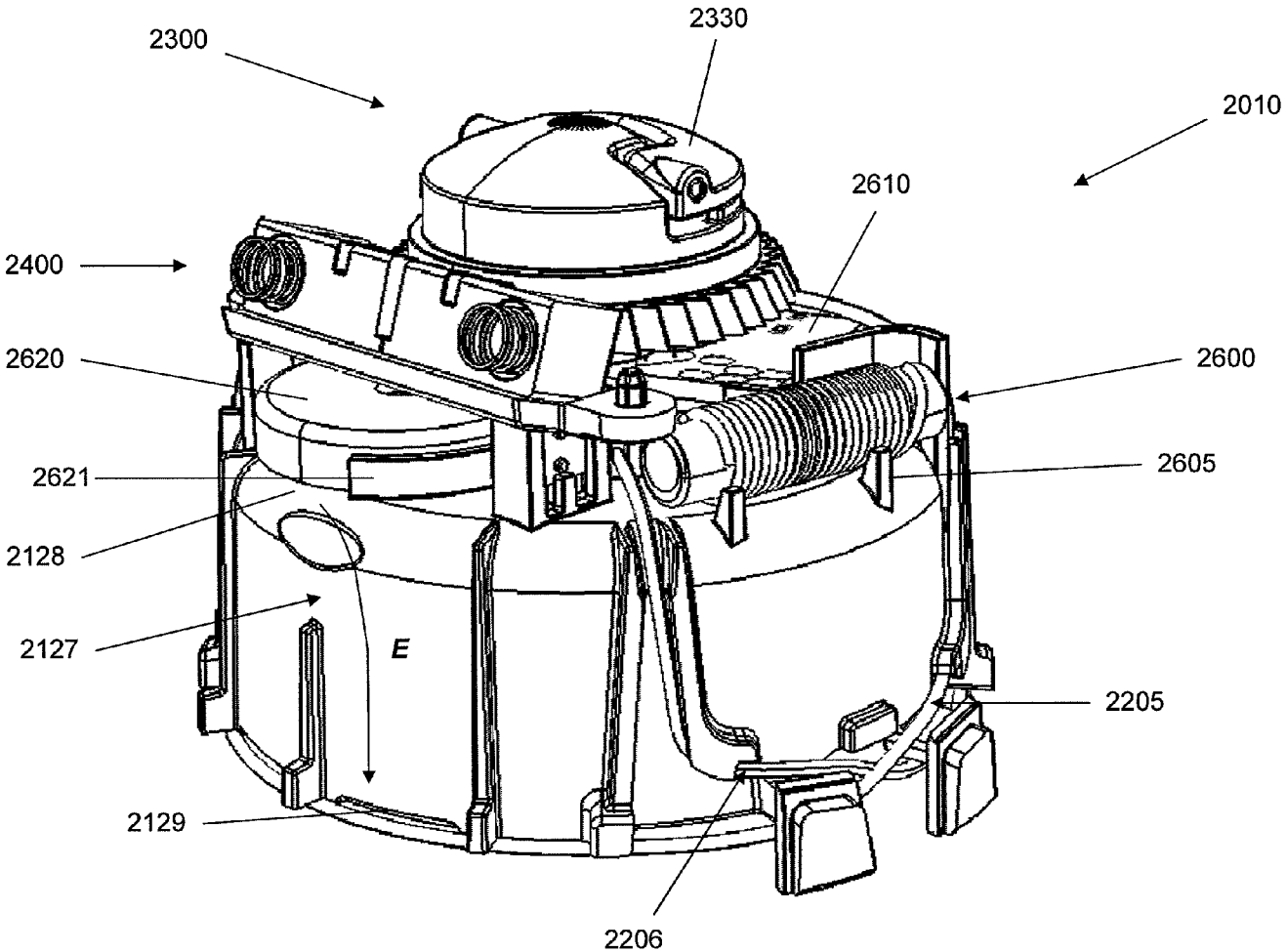
FIG. 18B is an opposite perspective view of the security device of FIG. 18A.

As illustrated by the partially sectioned view of FIG. 17, the housing 2100 is configured to at least partly enclose the cable 2200, the rotatable assembly 2300, the locking assembly (shown in FIGS. 18A, 18B), a security element (shown in FIG. 18B), a printed circuit board 2610 (shown in FIGS. 18A, 18B), a battery 2690 (shown in FIG. 18A), and a piezoelectric speaker 2620 (shown in FIG. 18B). The housing 2100 defines a cavity 2120 (shown in FIG. 20) and a perimeter rim 2130 (shown in FIG. 20) of the housing 2100 that extends around the cavity 2120.

FIGS. 18A and 18B are perspective views of the security device 2010 with the housing removed to better illustrate various internal components. The depicted security device 2010 comprises a collar 2121 that is structured to be received and supported within the cavity 2120 defined by the housing 2100. Notably, the depicted collar 2121 does not include a plurality of flanges as discussed above in connection with the embodiments of FIGS. 10-16. Instead, the collar 2121 defines a plurality of ribs 2123 that are configured to support and maintain a selected position for the cable 2200 respective to the collar 2121. The depicted collar 2121 further defines a plurality of tabs 2124 that are configured to support and maintain a selected position for the cable 2200 respective to the collar 2121. In one embodiment, the tabs 2124 are configured to engage the inner wall of the housing (see FIG. 17) in an interference or friction fit.

In addition, the collar 2121 may define anchor structures 2115 (e.g., pockets or similar structures) for anchoring a first cable terminal 2210 and a second cable terminal (not shown), thus, fixing the location of the cable terminals relative to the collar 2121 of the security device 2010. Alternatively, in other embodiments, the cable terminals may be retained by a portion of the housing of the security device, thus, fixing the location of the terminals within the housing. Finally, as illustrated in prior embodiments with respect to FIG. 13, the collar 2121 may define a spool support sleeve (not shown) that is adapted to receive and engage the spool of the rotatable assembly such that the rotatable assembly may be rotated relative to the collar as discussed in greater detail below.

The depicted collar 2121 defines a plurality of shoulders 2170. The shoulders 2170 define curved channels as shown to limit stress on the cable (i.e., avoid kinks or sharp turns) and ease movement of the cable 2200 when the cable 2200 is wound onto or removed from the spool 2310. The collar 2121 and the shoulders 2170 may collectively operate to reduce the likelihood of the cable binding, wearing prematurely, or being tampered with as will be apparent to one of ordinary skill in the art in view of this disclosure.

In one embodiment, as shown from the opposite side of the security device depicted in FIG. 18B, the collar 2121 may comprise a security element mount 2605 for supporting a security element 2600. In addition, the collar 2121 may comprise a printed circuit board mount 2611 for supporting a printed circuit board 2610. Further, the collar 2121 may comprise a speaker mount 2621 for supporting a piezoelectric speaker 2620.

Figure 19:
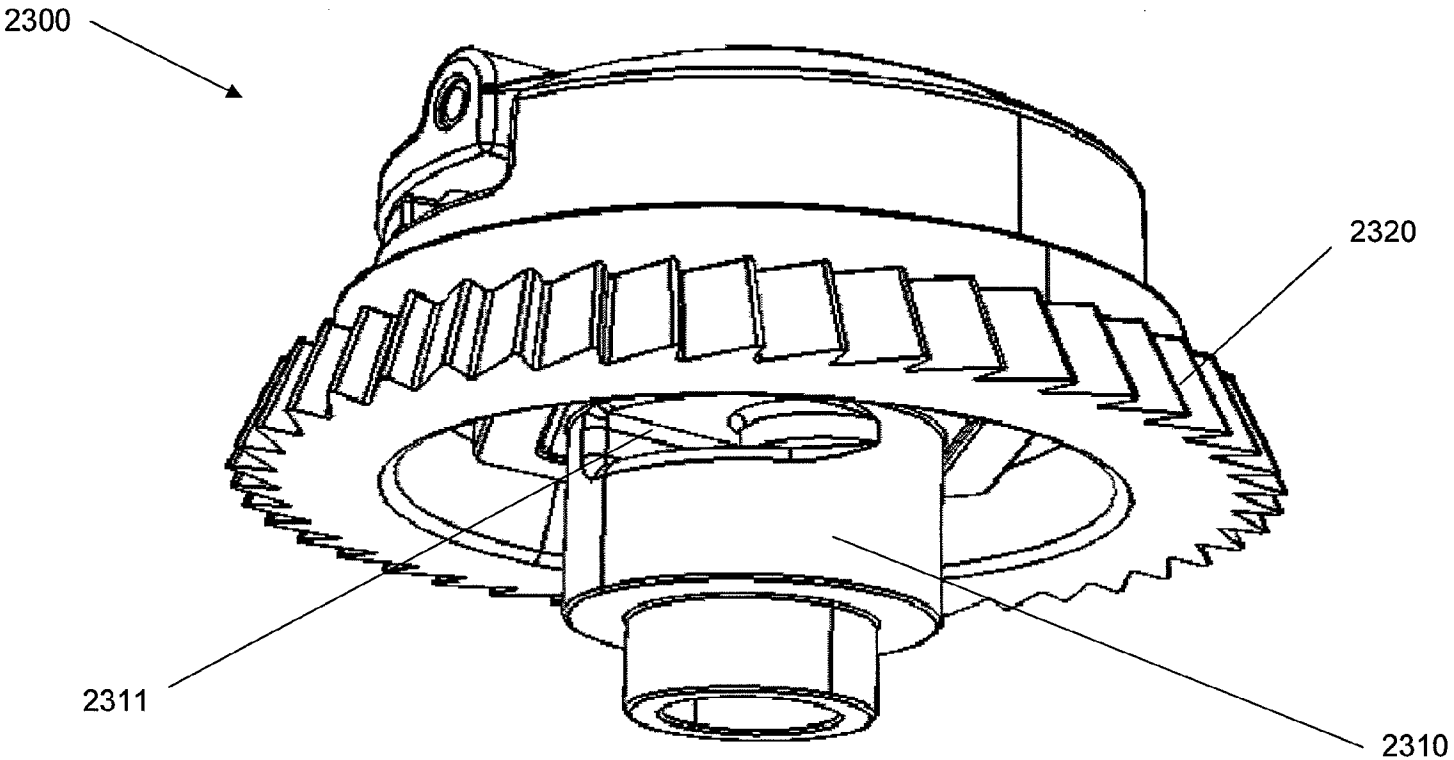
FIG. 19 is a perspective view of a rotatable assembly structured in accordance with one embodiment as removed from the security device of FIG. 17.

FIG. 19 illustrates a bottom perspective view of a rotatable assembly 2300 for a security device (not shown) structured in accordance with one embodiment of the invention. The depicted rotatable assembly 2300 comprises a spool 2310, a plurality of locking teeth 2320, and an engagement portion 2330. The spool 2310 defines a capture portion 2311 that is configured to engage a cable (not shown) and, like previous embodiments, to ensure that rotation of the rotatable assembly 2300 towards the winding or tightening direction causes at least a portion of the cable to be wound onto the spool 2310. In one embodiment, the cable 2200 is routed from a first cable terminal 2210, down and around the perimeter rim of one side of the collar 2121, up and through the capture portion 2311 defined by the spool 1310, down and around the other side of the collar 2121, and to a second cable terminal (not shown). In this regard, two cable loops 2205, 2206 (shown in FIG. 20) are defined in a manner similar to the embodiments depicted above in connection with FIGS. 1-16. The first securing loop 2205 of the cable 2200 is defined between the first cable terminal 2210 and the capture portion 2311 of the spool 2310 while the second cable loop 2206 is defined between the second cable terminal (not shown) and the capture portion 2311 of the spool 2310. Said differently, the capture portion 2311 of the spool 2310 defines the transition between the first and second securing loops 2205, 2206 of the cable 2200.

Figure 20:
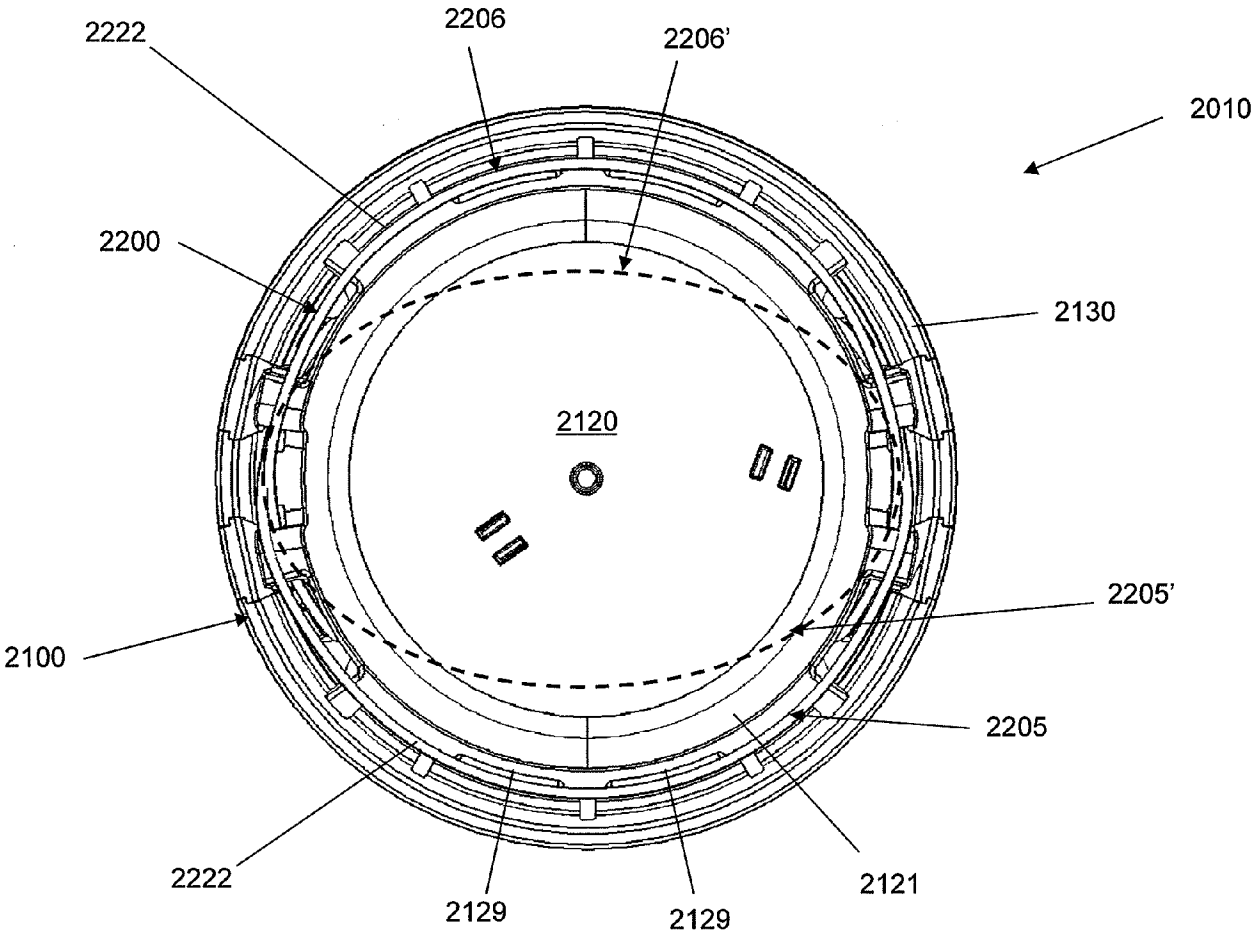
FIG. 20 is a bottom view of the security device of FIG. 17.

FIG. 20 illustrates a bottom view of a security device 2010 structured in accordance with one embodiment. Like the previous embodiments shown in FIGS. 2 and 10, the present embodiment, as shown in FIGS. 17-20, may be configured for attachment to an object having a flanged end or neck, e.g., a pill bottle. In the depicted embodiment, the pill bottle may be inserted into the cavity 2120 of the security device 2010 when the rotatable assembly is in an unwound position. The top portion of the pill bottle may include a flange defining a first diameter that is larger than a second diameter defined by a neck portion. The term "diameter" is meant to refer to a cross-sectional dimension such as a width, thickness, etc., and is not meant to be limited to products having a circular cross-section profile. Rather, the term "diameter" or "differing diameters" may be used to refer to various shapes, for example, bottles or other products that define a neck portion having a hexagonal shape, a square shape, a circular shape, and/or a triangular shape, etc.

Once the top portion of the pill bottle or other object is inserted, the rotatable assembly 2300 may be rotated in a tightening direction from the unwound or first position to the tightened position. Rotation of the rotatable assembly 2300 causes rotation of the spool 2310 such that the capture portion 2311 of the spool 2310 engages the cable 2200 and the cable 2200 is wound onto the spool 2310. Such winding of the cable 2200 causes the perimeter portions 2222 of the cable to retract and move inwardly towards the secured object to such a degree to enclose and secure the neck portion of the pill bottle. For example, in some embodiments, the cable 2200 may be tightened such that it moves inwardly, at least partly away from the perimeter rim 2130 of the housing 2100, to an object capture position 2205', 2206' illustrated by dashed lines in FIG. 20. In various embodiments, a locking assembly structured in accordance with various embodiments discussed herein may be used to prevent loosening and outward movement of the cable 2200 when disposed in the locked or engaged configuration.

In one embodiment, once the security device has been unlocked and the user wishes to remove the security device from an object, the cable 2200 may be returned to its original position proximate the perimeter rim 2130 of the housing 2100. As will be apparent to one of ordinary skill in the art in view of this disclosure, such a return may be accomplished by selecting a cable having a sufficient rigidity and elastic bias so as to conform to the generally circular shape of the perimeter rim in its rest (i.e., non-tightened position). In some embodiments, a slight tightening bias may be provided to the rotatable assembly (i.e., through a torsion spring or other similar means) to remove slack from the cable in an unlocked configuration; however, in one embodiment, such tightening bias may be selected so as to be slightly less than the elastic bias of the cable to ensure that the cable is not prematurely pulled from the perimeter rim of the housing in its rest position (i.e., non-tightened position).

The security device of the various embodiments of the present invention may further comprise a security element 600, 1600, 2600 (as shown in FIGS. 5, 12, and 18B) to deter and detect theft. In one embodiment, the security element may comprise an electronic article surveillance (EAS) element configured to be detectable when the EAS element is present in a predetermined detection zone, such as a zone located proximate a door or other point of entry of an establishment. The EAS element may be configured to work within an EAS security system. For example, the EAS element may include a magnetic tag, such as in an electromagnetic (EM) system or in an acousto-magnetic (AM) system, or the EAS element may include an electronic circuit and antenna, such as in a radio frequency (RF) system. The EAS element may further be configured to work within a microwave system. In another embodiment, the security module may further comprise other wireless devices, such as an active or passive RFID transponder or tag. The RFID tag may be used to store and/or communicate information about the object for security or inventory control purposes.

Various embodiments of the security device may further be configured with other security or alarm features. For instance, some embodiments may comprise an alarm module that comprises a piezoelectric speaker (620 in FIG. 5, 2620 in FIG. 18B) and associated electrical circuitry that is configured to trigger an audible alarm via the speaker in response to one or more alarm or alert conditions. One skilled in the art will appreciate the alarm module may comprise any device configured to emit an audible alarm and electrical circuitry associated with the device configured to trigger an alarm in response to certain conditions. In some embodiments, the security device is structured to isolate the alarm module against tampering or disablement while ensuring that any audible alarm emitted from the alarm module is actually detectable by a retail clerk or other appropriate personnel. In one embodiment, as shown in FIGS. 18B and 20, the housing 2100 of the security device 2010 further comprises an audible alarm channel 2127 having an anti-tamper portion 2128 and an exit gap 2129. In the depicted embodiment, the audible alarm channel 2127 proceeds along a curved path over a shoulder 2128 (i.e., anti-tamper portion) defined by the collar and toward the exit gap 2129 defined at the base of the perimeter rim of the housing. As discussed in greater detail below, the depicted shoulder 2128 cause the sound waves to proceed along a curved or tortured transmission path such that a would-be thief cannot disable the alarm module by simply inserting a common disabling instrument into the exit gap 2129 such as a screw driver, ice pick, or other device.

Turning to FIGS. 18B and 20, the depicted security device 2010 comprises a piezoelectric speaker 2620 supported proximate the top surface of the collar 2121. In one embodiment, the piezoelectric speaker 2620 is configured to produce sound waves that are channeled between the collar and the housing of the security device along arrow E so as to emerge from exit gaps 2129 (shown in FIG. 20) defined between the collar and the housing. In this embodiment, the piezoelectric speaker 2620 is advantageously configured to emit a detectable audio alarm while being isolated within the security device so that a would-be thief cannot easily disable or tamper with the speaker (i.e., such as by stabbing the speaker using a screw-driver through a conventional speaker grill). In the depicted embodiment, the isolation of the speaker 2620 or alarm module is facilitated by supporting such audio alarm emitting device at one end of the audio alarm channel 2127 having a curved, baffled, zig-zagged, etc., portion (i.e., anti-tamper portion) while defining the exit gap at the opposite end of the channel.

In other embodiments, the security device may further comprise a printed circuit board, a light-emitting diode (LED), and a battery. The LED may be configured to electrically communicate with the printed circuit board and the battery, and may extend at least partially through an opening defined by the outer cap of the rotatable assembly such that at least a portion of the LED is visible to the user or consumer. The LED may be used as an indicator (e.g., by providing a constant light or a blinking on/off light) of the existence of a particular condition or circumstance. For example, the LED may indicate that the security device has power, that the locking assembly is in the locked position, that the alarm is armed, or that the alarm has been triggered.

As explained in more detail in U.S. Pat. No. 7,497,101, which is incorporated by reference herein in its entirety, an alarm feature of the security device may be configured to activate in the event that a portion of the cable has been compromised, such as by being cut or damaged. For example, the cable may include or may itself be an electrically conductive element and may form a sense loop in contact with a trigger of the security device. Thus, in event that the cable is compromised, the trigger may be configured to detect the change in the cable and respond by activating the alarm. In this regard, the use of a single, continuous cable forming one or more loops allows for the monitoring of only one sense loop to trigger the alarm functionality, as opposed to monitoring multiple sense loops corresponding multiple cables.

In other embodiments, the trigger may be configured to excite and, thus, activate the alarm depending on the location of the EAS element with respect to the security system. The trigger may be configured to activate the alarm once the EAS element is near, at, or beyond a security system gate, which should help employees to detect the merchandise with the attached security device. Therefore, in some embodiments, the security device may have three alarm features: (1) the gates themselves alarming when the EAS element is detected; (2) the audible alarm (e.g., the piezoelectric speaker) of the security device itself triggering when the cable is compromised or otherwise tampered with; and (3) the audible alarm (e.g., the piezoelectric speaker) of the security device triggering when the EAS element is at, near, or beyond the security gates.

As mentioned previously, various embodiments of the security device may include a specially configured key comprising two magnets and one or more locating features or locating knobs configured to engage key locating indentations defined by the housing of the security device. When the key locating knobs and the locating indentations are aligned, the key magnets are positioned relative to the locking assembly of the security device to focus the magnetic fields of the key magnets towards the respectively aligned magnetically attractive elements. The application of the focused, well-aligned, dual magnetic fields causes the locking assembly to disengage. In some embodiments, keys structured for use with security devices as described herein may incorporate rare earth magnets in specific orientations and combinations to produce a specific flux field for disengaging the locking assembly.

As will be apparent to one of ordinary skill in the art in view of this disclosure, the biasing force used to bias the locking assembly toward the rotatable assembly, the relative positioning of the magnetically attractive elements within the locking assembly, the positioning of the magnetic fields produced by the specially configured key, and the magnitude or strength of the magnetic fields produced by the key, are all design considerations to be optimized for security purposes in connection with security device and key systems structured in accordance with the embodiments of the present invention. Similar locking assemblies may be used that include a unique physical profile of a key to disengage the locking assembly from the rotatable assembly.

In some embodiments, the security device may further comprise a winder mechanism (not shown). In particular and as further described in U.S. patent application Ser. No. 12/027,296, filed on Feb. 7, 2008, titled "Cable Wrap Security Device," the contents of which are hereby incorporated by reference in their entirety, the security device may include a winder mechanism that biases the rotatable assembly to a tightened position. The tightened position corresponds to a position in which the cable is substantially wound around the spool or that the cable loops have a minimum length. The winder mechanism may include a torsion spring extending from a first end to a second end. The torsion spring may be positioned within a center opening of the rotatable assembly with the first end attached to the rotatable assembly and the second end attached to a non-rotating element, such as a portion of the housing or the collar (shown as element 1121 in FIGS. 11-13). In the tightened position, the torsion spring may be at rest or in a rest state, and the spring may be configured to return to the rest state. According to these embodiments, as the rotatable assembly is rotated to unwind the cable, the spring is twisted. The more the rotatable assembly is rotated, the further the spring is twisted. Due to the connection between the torsion spring and the rotatable assembly, the torsion spring may be configured to return the rotatable assembly to the tightened position. Therefore, without a counter force, the torsion spring may be configured to move the rotatable assembly back to the tightened position and, thus, automatically wind a substantial portion of the cable onto the spool.

Many modifications and other embodiments of the inventions set forth herein will come to mind to one skilled in the art to which these inventions pertain having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A security device structured for attachment to an object, the security device comprising:

a housing;

a cable defining first and second ends that are each rigidly anchored within the housing; and a rotatable assembly supported within the housing, wherein the rotatable assembly further comprises a capture portion adapted to engage the cable between the first and second ends such that the cable penetrates through the rotatable assembly and the capture portion to define a first loop between the capture portion and the first end and a second loop between the capture portion and the second end, and wherein rotation of the rotatable assembly operates to tighten the first loop and the second loop:

wherein the first and second ends of the cable are anchored within the housing such that the rotatable assembly rotates relative to the first and second ends.

2. The security device of claim 1, wherein the rotatable assembly further comprises a spool, wherein rotation of the rotatable assembly causes the cable to be wound at least partially onto the spool.

3. The security device of claim 2, wherein the capture portion is defined by an aperture proximate the spool.

4. The security device of claim 1, wherein the first and second cable loops are configured for adjustment to differing sizes by sliding the cable through the capture portion.

5. The security device of claim 1, wherein the rotatable assembly further comprises locking teeth.

6. The security device of claim 1, wherein the rotatable assembly further comprises an engagement portion that is configured for grasping by a user during rotation of the rotatable assembly.

7. The security device of claim 6, wherein the engagement portion comprises a handle.

8. The security device of claim 1 further comprising a locking assembly, the locking assembly configured to move between a locked position and an unlocked position, wherein in the locked position, the locking assembly is positioned to prevent the rotatable assembly from rotating in a first direction while allowing the rotatable assembly to rotate in a second direction, and wherein in the unlocked position, the locking assembly is positioned to allow the rotatable assembly to rotate in the first direction and to rotate in the second direction.

9. The security device of claim 8, wherein the locking assembly comprises at least two magnetically attractive elements.

10. The security device of claim 8, wherein the locking assembly comprises biasing elements configured to bias the locking assembly toward the locked position.

11. The security device of claim 1 further comprising a security element.

12. The security device of claim 1 further comprising an audio alarm.

13. The security device of claim 1, wherein the cable comprises an electrically conductive element.

14. The security device of claim 13, wherein the cable forms part of an electrical sense loop, and wherein the security device is configured to alarm in response to a disruption detected within the electrical sense loop.

15. The security device of claim 1, wherein the housing is an exterior housing and wherein the first and second ends of the cable are rigidly anchored within the housing such that the first and second ends of the cable are prevented from moving relative to the housing.

16. A security device structured for attachment to an object, the security device comprising:

a housing defining a cavity and a perimeter rim extending at least partly around the cavity;

a cable extending at least partly within the cavity and proximate the perimeter rim, the cable defining first and second ends that are each rigidly anchored within the housing; and a rotatable assembly supported within the housing, wherein the rotatable assembly further comprises a capture portion adapted to engage the cable between the first and second ends such that the cable penetrates through the rotatable assembly and the capture portion to define a first loop between the capture portion and the first end and a second loop between the capture portion and the second end, and wherein rotation of the rotatable assembly operates to tighten the first loop and the second loop;

wherein the first and second ends of the cable are anchored within the housing such that the rotatable assembly rotates relative to the first and second ends.

17. The security device of claim 16, wherein the rotatable assembly further comprises a spool, and wherein rotation of the rotatable assembly causes the cable to be wound at least partially onto the spool.

18. The security device of claim 17, wherein the capture portion is defined by a recess within the spool.

19. The security device of claim 16, wherein the rotatable assembly further comprises locking teeth.

20. The security device of claim 16, wherein the rotatable assembly further comprises an engagement portion that is configured for grasping by a user during rotation of the rotatable assembly.

21. The security device of claim 20, wherein the engagement portion comprises a handle.

22. The security device of claim 16 further comprising a locking assembly, the locking assembly configured to move between a locked position and an unlocked position, wherein in the locked position, the locking assembly is positioned to prevent the rotatable assembly from rotating in a first direction while allowing the rotatable assembly to rotate in a second direction, and wherein in the unlocked position, the locking assembly is positioned to allow the rotatable assembly to rotate in the first direction and to rotate in the second direction.

23. The security device of claim 22, wherein the locking assembly comprises two sliding elements that are each configured to move independently between the locked position and the unlocked position.

24. The security device of claim 23, wherein each of the two sliding elements comprise a magnetically attractive element.

25. The security device of claim 23, wherein each of the two sliding elements comprise a biasing element.

26. The security device of claim 16 further comprising a security element.

27. The security device of claim 16 further comprising a printed circuit board.

28. The security device of claim 16 further comprising an audio alarm, the audio alarm further configured to produce a sound that is channeled out the cavity.

29. The security device of claim 16, wherein the housing is further configured to at least partly define an audible alarm channel, the audible alarm channel comprising an anti-tamper portion and an exit gap.

30. The security device of claim 29, the security device further comprising an alarm module supported within the housing and configured to emit an audible alarm into the audible alarm channel, and wherein the anti-tamper portion is structured to reduce tampering with the alarm module through the exit gap.

31. The security device of claim 16, wherein the cable comprises an electrically conductive element.

32. The security device of claim 16 further comprising a collar member, wherein the cable is disposed at least partially between the housing and the collar member.

33. The security device of claim 32, wherein the collar member comprises a plurality of flanges, wherein rotation of the rotatable assembly and tightening of the first loop and the second loop operates to drive the plurality of flanges toward a center of the cavity.

34. The security device of claim 16, wherein the rotatable assembly is rotationally biased toward a tightened position.

35. The security device of claim 16, wherein the rotatable assembly is configured to rotate between a first position and a tightened position, wherein the security device defines a first object engagement diameter when the rotatable assembly is in the first position and a second object engagement diameter when the rotatable assembly is in the tightened position, and wherein the second object engagement diameter is smaller than the first object engagement diameter.

* * * * *